US010761444B2

(12) United States Patent
Sugawara et al.

(10) Patent No.: US 10,761,444 B2
(45) Date of Patent: Sep. 1, 2020

(54) ELECTROSTATIC CHARGE IMAGE DEVELOPMENT TONER AND ELECTROSTATIC CHARGE IMAGE DEVELOPER

(71) Applicant: FUJI XEROX CO., LTD., Tokyo (JP)

(72) Inventors: Atsushi Sugawara, Kanagawa (JP); Yasuo Kadokura, Kanagawa (JP); Daisuke Tomita, Kanagawa (JP); Sakiko Hirai, Kanagawa (JP); Satoshi Miura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/261,500

(22) Filed: Jan. 29, 2019

(65) Prior Publication Data

US 2020/0089137 A1 Mar. 19, 2020

(30) Foreign Application Priority Data

Sep. 14, 2018 (JP) ..... 2018-172100

(51) Int. Cl.
*G03G 9/08* (2006.01)
*G03G 9/087* (2006.01)

(52) U.S. Cl.
CPC ..... *G03G 9/0819* (2013.01); *G03G 9/0821* (2013.01); *G03G 9/08711* (2013.01); *G03G 9/08755* (2013.01)

(58) Field of Classification Search
CPC ..... G03G 9/0821
USPC ..... 430/111.4
See application file for complete search history.

(56) References Cited

U.S. PATENT DOCUMENTS

| | | | | |
|---|---|---|---|---|
| 6,040,104 | A | 3/2000 | Nakamura et al. | |
| 8,822,120 | B2 | 9/2014 | Abe et al. | |
| 2016/0282736 | A1* | 9/2016 | Furukawa | G03G 9/08711 |
| 2017/0082935 | A1* | 3/2017 | Shiozaki | G03G 9/08755 |

FOREIGN PATENT DOCUMENTS

| | | |
|---|---|---|
| JP | H08334926 | 12/1996 |
| JP | H10333352 | 12/1998 |
| JP | H11194542 | 7/1999 |
| JP | 2012098714 | 5/2012 |

* cited by examiner

*Primary Examiner* — Mark A Chapman
(74) *Attorney, Agent, or Firm* — JCIPRNET

(57) ABSTRACT

An electrostatic charge image development toner satisfies the following: a maximum slope of an absolute value of log (loss modulus G") from 60° C. to 90° C. is 0.07 or more and 0.16 or less; a maximum slope of an absolute value of log (loss modulus G") from 90° C. to 130° C. is 0.08 or less; and G"(60) is $5.0\times10^{7}$ Pa or more and $1.0\times10^{10}$ Pa or less, where G"(60) is a loss modulus at 60° C.

15 Claims, 2 Drawing Sheets

ELECTROSTATIC CHARGE IMAGE DEVELOPMENT TONER AND ELECTROSTATIC CHARGE IMAGE DEVELOPER

CROSS-REFERENCE TO RELATED APPLICATIONS

This application is based on and claims priority under 35 USC 119 from Japanese Patent Application No. 2018-172100 filed Sep. 14, 2018.

BACKGROUND

(i) Technical Field

The present disclosure relates to an electrostatic charge image development toner and an electrostatic charge image developer.

(ii) Related Art

Electrophotography is one of methods for visualizing image information through electrostatic charge images and currently used in various fields.

In the related art, electrophotography typically involves visualizing image information through a plurality of steps including forming an electrostatic latent image on a photoreceptor or an electrostatic recording medium using various techniques, developing the electrostatic latent image (toner image) by attaching electroscopic particles, which are called toner, to the electrostatic latent image, transferring the developed image onto the surface of a transfer receptor, and fixing the image through heating or the like.

Japanese Unexamined Patent Application Publication No. 8-334926 discloses an electrostatic image development toner containing at least a binder resin and a coloring agent. The binder resin includes a mixture of a high-molecular-weight component and a low-molecular-weight component. When the common logarithm (log η') of the apparent viscosity of the high-molecular-weight component obtained by using a Koka flow tester is plotted as a function of temperature, the absolute value (kHP) of the slope of the graph is $0.003 \leq (kHP) \leq 0.02$ log(poise)/° C. The absolute value (kLP) of the slope of the graph for the low-molecular-weight component is $0.07 \leq (kLP) \leq 0.1$ log(poise)/° C. The mixing ratio of the high-molecular-weight component to the low-molecular-weight component is from 5/95 to 50/50. The absolute value (k binder) of the slope of the graph for the resin mixture is $0.03 \leq (k\ binder) \leq 0.06$ log(poise)/° C.

Japanese Unexamined Patent Application Publication No. 2012-98714 discloses a toner containing inorganic fine powder and toner particles containing a binder resin, a coloring agent, and a wax. The wax has i) a temperature at 0.2 mass % weight loss of 200° C. or higher and a temperature at 1.0 mass % weight loss of 250° C. or higher, and has ii) a melt viscosity at 120° C. of 3.0 to 15.0 mPa·s.

Japanese Unexamined Patent Application Publication No. 10-333352 discloses an electrostatic charge image development toner containing at least a coloring agent and a binder resin. In the relationship between the dynamic viscosity η (poise) of the toner and temperature T (° C.) in accordance with Formula (1), the value of E(T) at a temperature of 50° C. is 25 kJ/mol or less, and the maximum value of E(T) at a temperature of 55° C. or higher and 75° C. or lower is 250 kJ/mol or more.

$$2.3025 \times \log_{10}\eta = A + E(T)/R(T+273.15) \quad (1)$$

wherein A is a constant, and R is a molar gas constant (8.3144 J/mol·K).

Japanese Unexamined Patent Application Publication No. 11-194542 discloses an electrophotographic toner containing a binder resin and a coloring agent. The minimum value of tan δ of the binder resin is located between the glass transition temperature (Tg) and the temperature at which the loss modulus (G") becomes $G''=1\times10^4$ Pa. The minimum value of tan δ is less than 1.2, and the storage modulus (G') at the temperature corresponding to the minimum value of tan δ is greater than or equal to $G'=5\times10^5$ Pa, and the value of tan δ at the temperature at which the loss modulus (G") becomes $G''=1\times10^4$ Pa is 3.0 or more.

SUMMARY

Aspects of non-limiting embodiments of the present disclosure relate to an electrostatic charge image development toner that may provide images with less gloss unevenness even when recording media stored in a low-temperature environment (4° C.) are used compared with a toner obtained in the case where the maximum slope of the absolute value of log (loss modulus G") from 60° C. to 90° C. is less than 0.07 or more than 0.16, the maximum slope of the absolute value of log (loss modulus G") from 90° C. to 130° C. is more than 0.08, or G"(60) is less than $5.0\times10^7$ Pa or more than $1.0\times10^{10}$ Pa, where G"(60) is a loss modulus at 60° C.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided an electrostatic charge image development toner satisfying the following: a maximum slope of an absolute value of log (loss modulus G") from 60° C. to 90° C. is 0.07 or more and 0.16 or less; and a maximum slope of an absolute value of log (loss modulus G") from 90° C. to 130° C. is 0.08 or less, wherein G"(60) is $5.0\times10^7$ Pa or more and $1.0\times10^{10}$ Pa or less, where G"(60) is a loss modulus at 60° C.

BRIEF DESCRIPTION OF THE DRAWINGS

Exemplary embodiments of the present disclosure will be described in detail based on the following figures, wherein.

DETAILED DESCRIPTION

Figure 1:
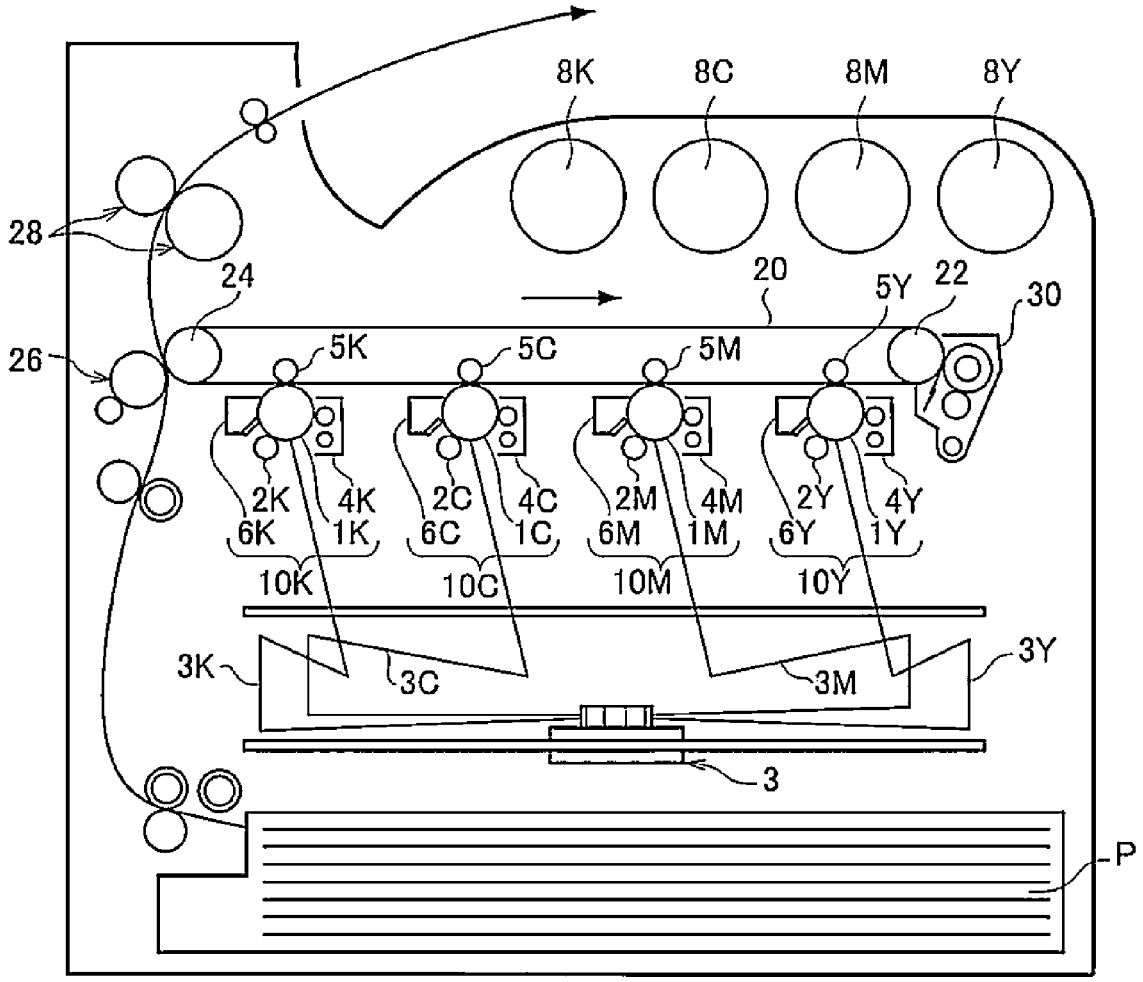
FIG. 1 is a schematic view of an image forming apparatus according to an exemplary embodiment.

In this specification, the amount of a component in a composition refers to, when there are several substances corresponding to the component in the composition, the total amount of the substances present in the composition, unless otherwise specified.

In this specification, the "electrostatic charge image development toner" is also referred to simply as "toner", and the "electrostatic charge image developer" is also referred to simply as a "developer."

Exemplary embodiments of the present disclosure will be described below.

Electrostatic Charge Image Development Toner

An electrostatic charge image development toner according to this exemplary embodiment satisfies the following: the maximum slope of the absolute value of log (loss modulus G") from 60° C. to 90° C. is 0.07 or more and 0.16 or less; the maximum slope of the absolute value of log (loss modulus G") from 90° C. to 130° C. is 0.08 or less; and G"(60) is $5.0\times10^7$ Pa or more and $1.0\times10^{10}$ Pa or less, where G"(60) is a loss modulus at 60° C.

The electrostatic charge image development toner according to this exemplary embodiment may have two aspects described below.

To reduce gloss unevenness, the electrostatic charge image development toner according to this exemplary embodiment in one aspect preferably satisfies the following: the maximum slope of the absolute value of log (loss modulus G") from 60° C. to 90° C. is 0.08 or more and 0.16 or less; the maximum slope of the absolute value of log (loss modulus G") from 90° C. to 130° C. is 0.08 or less; and G"(60) is $1.0\times10^8$ Pa or more and $1.0\times10^{10}$ Pa or less, where G"(60) is a loss modulus at 60° C. The electrostatic charge image development toner according to this exemplary embodiment in one aspect more preferably contains a styrene-acrylic resin as a binder resin.

To reduce gloss unevenness, the electrostatic charge image development toner according to this exemplary embodiment in another aspect preferably satisfies the following: the maximum slope of the absolute value of log (loss modulus G") from 60° C. to 90° C. is 0.07 or more and 0.14 or less; the maximum slope of the absolute value of log (loss modulus G") from 90° C. to 130° C. is 0.08 or less; and G"(60) is $5.0\times10^7$ Pa or more and $5.0\times10^9$ Pa or less, where G"(60) is a loss modulus at 60° C. The electrostatic charge image development toner according to this exemplary embodiment in another aspect more preferably contains an amorphous polyester resin as a binder resin.

If recording media stored at a low temperature (4° C.) are used for printing in a sufficiently warm room in winter, condensation tends to occur due to a low cooling rate, and recording media may absorb water. Even when the fixing temperature reaches a predetermined temperature during fixation, the use of cold recording media during fixation may lower the temperature during fixation. Furthermore, the removal of the fixing heat by water in water-absorbing recording media may further lower the temperature during fixation.

In printing a solid image on a first recording medium, the top edge and the bottom edge of the recording medium have large differences in temperature. As a result, the top edge and the bottom edge of the recording medium have large differences in toner viscosity, which may cause gloss unevenness.

As the number of copies increases, the fixing heat warms the fixing unit. In the initial printing stage where the number of copies is 1 to 5, however, the temperature is unstable between 60° C. and 130° C., and gloss unevenness may tend to occur.

The electrostatic charge image development toner according to this exemplary embodiment having the above feature may provide images with less gloss unevenness even when recording media stored in a low-temperature environment (4° C.) are used. The reason for this is not clear but assumed as described below.

In the case where G"(60), which is a loss modulus at 60° C., is $5.0\times10^7$ Pa or more and $1.0\times10^{10}$ Pa or less, and the maximum slope of the absolute value of log (loss modulus G") from 60° C. to 90° C. is 0.07 or more and 0.16 or less, the first recording medium has less gloss unevenness due to a small difference in viscosity from a fixing temperature of 60° C., which is most cooled in winter, to a bottom edge temperature of 90° C. in printing on the first recording medium. In the case where the maximum slope of the absolute value of log (loss modulus G") from 90° C. to 130° C. is 0.08 or less, the second to fifth recording media have less gloss unevenness due to a small difference in viscosity from 90° C. to 130° C. (corresponding to the temperature in fixation to the fifth recording medium). As a result, the electrostatic charge image development toner may provide images with less gloss unevenness even when recording media stored in a low-temperature environment are used.

The electrostatic charge image development toner according to this exemplary embodiment will be described below in detail.

Loss Modulus G" of Toner and Characteristic Values Using Loss Modulus G"

The electrostatic charge image development toner according to this exemplary embodiment satisfies the following:

the maximum slope of the absolute value of log (loss modulus G") from 60° C. to 90° C. is 0.07 or more and 0.16 or less;

the maximum slope of the absolute value of log (loss modulus G") from 90° C. to 130° C. is 0.08 or less; and G"(60) is $5.0\times10^7$ Pa or more and $1.0\times10^{10}$ Pa or less, where G"(60) is a loss modulus at 60° C.

In the present disclosure, "log" is the common logarithm.

The unit of the loss modulus of the toner in this exemplary embodiment is Pa, unless otherwise specified.

The loss modulus of the toner in this exemplary embodiment is a value determined by temperature-rising measurement at a heating rate of 1° C./min from about 40° C. to 150° C. with a sample weight of about 0.3 g and a distortion of 20% or less at a frequency of 1 Hz/sec using a rotational plate rheometer (RDA2, RHIOS system ver. 4.3 available from Rheometrics, Inc.) with parallel plates 8 mm in diameter.

The lower limit of the maximum slope of the absolute value of log (loss modulus G") from 60° C. to 90° C., which is one of characteristic values in this exemplary embodiment, is 0.07 or more, preferably 0.08 or more, more preferably 0.09 or more, and still more preferably 0.10 or more, to reduce gloss unevenness.

The upper limit of the maximum slope of the absolute value of log (loss modulus G") from 60° C. to 90° C. is 0.16 or less, preferably 0.15 or less, more preferably 0.14 or less, and still more preferably 0.13 or less, to reduce gloss unevenness.

The maximum slope of the absolute value of log (loss modulus G") from 90° C. to 130° C., which is one of characteristic values in this exemplary embodiment, is 0.08 or less, preferably 0.07 or less, more preferably 0.04 or more and 0.07 or less, and still more preferably 0.045 or more and 0.065 or less, to reduce gloss unevenness.

The lower limit of G"(60), which is a loss modulus at 60° C. and one of characteristic values in this exemplary embodiment, is $5.0\times10^7$ Pa or more, preferably $7.0\times10^7$ Pa or more, more preferably $1.0\times10^8$ Pa or more, and still more preferably $3.0\times10^8$ Pa or more, to reduce gloss unevenness.

The upper limit of G"(60) is $1.0\times10^{10}$ Pa or less, preferably $5.0\times10^9$ Pa or less, more preferably $2.0\times10^9$ Pa or less, and still more preferably $1.0\times10^9$ Pa or less, to reduce gloss unevenness.

Maximum Endothermic Peak Temperature of Toner

The maximum endothermic peak temperature of the electrostatic charge image development toner according to this exemplary embodiment is preferably 70° C. or higher and 100° C. or lower, more preferably 75° C. or higher and 95° C. or lower, and still more preferably 85° C. or higher and 95° C. or lower to reduce gloss unevenness and in view of fixability.

The maximum endothermic peak temperature of the toner in this exemplary embodiment is a temperature that gives the maximum endothermic peak in the endothermic curve including at least the range from −30° C. to 150° C. in differential scanning calorimetry.

The method for measuring the maximum endothermic peak temperature of the toner in this exemplary embodiment will be described below.

This method uses a differential thermal scanning calorimeter DSC-7 available from PerkinElmer, Co., Ltd., where temperature calibration of the detector in the device is performed using the melting point of indium and zinc, and calibration for the amount of heat is performed using the heat of fusion of indium. An aluminum pan is used as a sample pan, and an empty pan is set as reference. The temperature is raised from room temperature to 150° C. at a heating rate of 10° C./min, lowered from 150° C. to −30° C. at a rate of 10° C./min, and then raised from −30° C. to 150° C. at a rate of 10° C./min. The maximum temperature at the endothermic peak in second temperature rising is defined as the maximum endothermic peak temperature.

Gel Fraction of Binder Resin in Toner

In the case where the electrostatic charge image development toner according to this exemplary embodiment contains a styrene-acrylic resin as a binder resin, the gel fraction of the binder resin in the toner is preferably 0.1 mass % or more and 10 mass % or less, more preferably 0.5 mass % or more and 8.0 mass % or less, and still more preferably 1.0 mass % or more and 6.0 mass % or less, to reduce gloss unevenness and cold offset.

The gel content in the binder resin is generated by three-dimensional cross-linking of the resin. The gel content suppresses a decrease in the viscosity of the resin at high temperatures. As a result, the gel content in the resin reduces a change in viscosity between high temperatures and low temperatures, and thus reduces a change in toner viscosity during fixation.

The gel fraction of the binder resin in this exemplary embodiment is determined as follows.

In the case where a toner of interest has an external additive, first, toner particles (base particles) are obtained by removing the external additive using a known method, such as a method for exposing the toner to ultrasonic vibrations in a liquid.

Next, the toner particles are placed in an Erlenmeyer flask, and tetrahydrofuran (THF) heated to 45° C. is placed in the Erlenmeyer flask. The Erlenmeyer flask is sealed and left to stand for 24 hours. In this case, a thermostatic bath capable of maintaining the temperature at 45° C. may be used. The entire content in the Erlenmeyer flask is then transferred to a glass tube for centrifugation and subjected to centrifugation at a number of rotation of 20,000 rpm (revolutions per minute) and −10° C. for 30 minutes. After centrifugation, the entire content is taken out and left to stand in a thermostatic bath at 45° C. The supernatant, which is a THF-soluble portion, is separated from the precipitate containing THF-insoluble components at 45° C. Subsequently, the amount of THF-soluble resin can be measured by drying the supernatant.

Next, the obtained THF-insoluble components at 45° C. are heated to 600° C. at a heating rate of 20° C./min under nitrogen gas flow. As a result, a release agent volatilizes in an early stage, and the resin component-derived solid (that is, gel-like resin component) is then thermally decomposed. The residue mainly includes a pigment-derived component and very small amounts of other additives (e.g., inorganic component-derived solid). From the proportion of the residue, the amount of the resin component-derived gel, which is a THF-insoluble component at 45° C. other than the pigment, the release agent, and the external additive in the toner, can be determined. The gel fraction of the resin component in the toner is determined in accordance with the following formula.

Gel fraction(mass %)=amount of resin component-derived gel/(amount of resin component-derived gel+amount of THF-soluble resin)×100

Since changes in the viscosity of resin at high temperatures are suppressed in this exemplary embodiment, insoluble resin that is not dissolved even in THF at 45° C. is taken into consideration. It is thus possible to reduce gloss unevenness, namely, gloss difference, even under given fixation conditions where temperature changes as in the present disclosure.

The insoluble resin in THF at 45° C. can contribute to ionic crosslinking and vulcanization with sulfur in the toner and can provide a rubber component in the toner.

Examples of elements for ionic crosslinking include metals, such as alkali metals and alkaline earth metals; and metals, such as transition elements. To allow the binder resin in the toner to contain three-dimensional crosslinked gel as in the present disclosure, a trivalent or higher valent metal, such as aluminum, is preferred.

Al Content in Toner

The Al content in the electrostatic charge image development toner according to this exemplary embodiment is preferably 0.01 mass % or more and 1 mass % or less, more preferably 0.05 mass % or more and 0.5 mass % or less, and still more preferably 0.07 mass % or more and 0.3 mass % or less, to reduce gloss unevenness and cold offset.

The amount of aluminum element in the toner is determined on the basis of fluorescent X-ray NET intensity.

The fluorescent X-ray NET intensity of aluminum element is measured by using the following method.

First, 0.130 g of toner particles are formed into a disc. The obtained disc is subjected to qualitative and quantitative total elemental analysis with a fluorescent X-ray analyzer (XRF-1500 available from Shimadzu Corporation) under the conditions of an X-ray output from 40 V-70 mA, a measurement area of 10 mm Ø, and a measurement time of 15 minutes. The obtained intensity of Al Kα (the intensity of the peak from Al) is determined as the "fluorescent X-ray NET intensity of aluminum element". If the peak from Al overlaps peaks from other elements, the intensity of the peak from Al is calculated after analysis by high-frequency inductively coupled plasma (ICP) emission spectrometry or atomic absorption spectrometry.

In the case where the toner contains an externally added external additive, for example, the toner is dispersed in ion exchange water containing a dispersant, such as a surfactant, and the toner particles are ultrasonically separated from the external additive with an ultrasonic homogenizer (US-300T: Nippon Seiki Co., Ltd.) or the like. Subsequently, the toner particles are solely obtained by filtering and washing and used as a test sample.

BET Specific Surface Area of Toner

To reduce gloss unevenness, the BET specific surface area of the electrostatic charge image development toner according to this exemplary embodiment is preferably 1.3 $m^2/g$ or more and 2.8 $m^2/g$ or less, more preferably 1.5 $m^2/g$ or more and 2.5 $m^2/g$ or less, and still more preferably 1.7 $m^2/g$ or more and 2.1 $m^2/g$ or less.

The BET specific surface area of the toner is a value measured by the BET method. The BET specific surface area is obtained under nitrogen purging by using a BET surface area analyzer (SA 3100 available from Beckman Coulter, Inc.) as a measurement device. Specifically, the BET specific surface area ($m^2/g$) is a value obtained as follows: 1 g of the test sample is weighed out and placed in a sample tube, and the sample tube is then degassed and subjected to multipoint automatic measurement.

Infrared Absorption Spectrum of Toner Particles

In the case where the electrostatic charge image development toner according to this exemplary embodiment contains an amorphous polyester resin described below as a binder resin, the ratio of the absorbance at a wavelength of 1,500 $cm^{-1}$ to the absorbance at a wavelength of 720 $cm^{-1}$ (absorbance at wavelength of 1,500 $cm^{-1}$/absorbance at wavelength of 720 $cm^{-1}$) is preferably 0.6 or less, and the ratio of the absorbance at a wavelength of 820 $cm^{-1}$ to the absorbance at a wavelength of 720 $cm^{-1}$ (absorbance at wavelength of 820 $cm^{-1}$/absorbance at wavelength of 720 $cm^{-1}$) is preferably 0.4 or less in infrared absorption spectrum analysis of toner particles in the electrostatic charge image development toner according to this exemplary embodiment to reduce gloss unevenness. The ratio of the absorbance at a wavelength of 1,500 $cm^{-1}$ to the absorbance at a wavelength of 720 $cm^{-1}$ is more preferably 0.4 or less, and the ratio of the absorbance at a wavelength of 820 $cm^{-1}$ to the absorbance at a wavelength of 720 $cm^{-1}$ is more preferably 0.2 or less in infrared absorption spectrum analysis of toner particles. The ratio of the absorbance at a wavelength of 1,500 $cm^{-1}$ to the absorbance at a wavelength of 720 $cm^{-1}$ is still more preferably 0.2 or more and 0.4 or less, and the ratio of the absorbance at a wavelength of 820 $cm^{-1}$ to the absorbance at a wavelength of 720 $cm^{-1}$ is still more preferably 0.05 or more and 0.2 or less in infrared absorption spectrum analysis of toner particles.

The measurement of the absorbance at given wavelengths by infrared absorption spectrum analysis in this exemplary embodiment is carried out by using the following process. First, toner particles (formed by removing an external additive from toner if necessary) to be measured are prepared as a teat sample by using the KBr pellet method. The test sample is then subjected to measurement with an infrared spectrophotometer (FT-IR-410 available from JASCO Corporation) in the range from wavenumber 500 $cm^{-1}$ to 4,000 $cm^{-1}$ under the conditions of an integration number of 300 times and a resolution of 4 $cm^{-1}$. Baseline correction is performed in, for example, an offset region where absorption of light does not occur, and the absorbance at given wavelengths is obtained.

In the electrostatic charge image development toner according to this exemplary embodiment, the ratio of the absorbance at a wavelength of 1,500 $cm^{-1}$ to the absorbance at a wavelength of 720 $cm^{-1}$ in infrared absorption spectrum analysis of toner particles is preferably 0.6 or less, more preferably 0.4 or less, still more preferably 0.2 or more and 0.4 or less, and yet still more preferably 0.3 or more and 0.4 or less to reduce gloss unevenness.

In the electrostatic charge image development toner according to this exemplary embodiment, the ratio of the absorbance at a wavelength of 820 $cm^{-1}$ to the absorbance at a wavelength of 720 $cm^{-1}$ in infrared absorption spectrum analysis of toner particles is preferably 0.4 or less, more preferably 0.2 or less, still more preferably 0.05 or more and 0.2 or less, and yet still more preferably 0.08 or more and 0.2 or less to reduce gloss unevenness.

½ Outflow Temperature of Toner in Flow Tester

In the case where the electrostatic charge image development toner according to this exemplary embodiment contains an amorphous polyester resin as a binder resin, the ½ outflow temperature of the toner as determined with a flow tester is preferably 100° C. or higher and 220° C. or lower, more preferably 120° C. or higher and 200° C. or lower, and still more preferably 140° C. or higher and 180° C. or lower, to reduce gloss unevenness and cold offset.

The ½ outflow temperature of the toner according to this exemplary embodiment as determined with a flow tester is measured with a Koka flow tester CFT-500C (available from Shimadzu Corporation). The ½ outflow temperature refers to the temperature corresponding to half the height from the outflow start point to the end point when 1.1 g of the sample melts and flows out under the following conditions: die pore size 0.5 mm, die pore length 1 mm, pressure load 0.98 MPa (10 $kg/cm^2$), preheating time 5 minutes, heating rate 1° C./min, measured temperature interval 1° C., and starting temperature 65° C.

The toner according to this exemplary embodiment contains toner particles (also referred to as "toner base particles") and, if necessary, an external additive.

Toner Particles

The toner particles contain, for example, a binder resin and, if necessary, a coloring agent, a release agent, and other additives, and preferably contain a binder resin and a release agent.

In this exemplary embodiment, examples of the toner particles include, but are not limited to, toner particles of yellow toner, magenta toner, cyan toner, black toner, and the like; and white toner particles, transparent toner particles, and photoluminescent toner particles.

Binder Resin

Examples of the binder resin include vinyl resins composed of a homopolymer of a monomer or a copolymer of two or more monomers of, for example, styrenes (e.g., styrene, p-chlorostyrene, α-methylstyrene), (meth)acrylic acid esters (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate), ethylenically unsaturated nitriles (e.g., acrylonitrile, methacrylonitrile), vinyl ethers (e.g., vinyl methyl ether, vinyl isobutyl ether), vinyl ketones (e.g., vinyl methyl ketone, vinyl ethyl ketone, vinyl isopropenyl ketone), and olefins (e.g., ethylene, propylene, butadiene).

Examples of the binder resin include non-vinyl resins, such as epoxy resins, polyester resins, polyurethane resins, polyamide resins, cellulose resins, polyether resins, and modified rosins; and mixtures of these non-vinyl resins and the above vinyl resins, and graft polymers obtained by polymerization of a vinyl monomer in the presence of these non-vinyl resins.

These binder resins may be used alone or in combination of two or more.

To eliminate or reduce image defects, the binder resin preferably contains at least one selected from the group consisting of styrene-acrylic resins and non-crystalline (amorphous) polyester resins, more preferably contains a styrene-acrylic resin or an amorphous polyester resin, still more preferably contains 50 mass % or more of a styrene-acrylic resin or an amorphous polyester resin with respect to the total mass of the binder resin contained in the toner, and yet still more preferably contains 80 mass % or more of a styrene-acrylic resin or an amorphous polyester resin with respect to the total mass of the binder resin contained in the toner.

The electrostatic charge image development toner according to this exemplary embodiment may contain a styrene-acrylic resin as a binder resin in view of the strength and storage stability of the toner.

The electrostatic charge image development toner according to this exemplary embodiment may contain an amorphous polyester resin as a binder resin in view of low-temperature fixability.

The amorphous polyester resin may be an amorphous polyester resin having no bisphenol structure to eliminate or reduce image defects and in view of fixability.

The binder resin is preferably a styrene-acrylic resin.

The styrene-acrylic resin is a copolymer produced by copolymerization of at least a styrene-based monomer (a monomer having a styrene backbone) and a (meth)acrylic monomer (a monomer having a (meth)acrylic group, preferably a monomer having a (meth)acryloxy group). The styrene-acrylic resin contains, for example, a copolymer of a monomer of a styrene and a monomer of the (meth)acrylic acid ester.

The acrylic resin moiety in the styrene-acrylic resin is a partial structure formed by polymerization of one or both of an acrylic monomer and a methacrylic monomer. The term "(meth)acrylic" is an expression including both "acrylic" and "methacrylic."

Specific examples of the styrene-based monomer include styrene, alkylated styrenes (e.g., α-methylstyrene, 2-methylstyrene, 3-methylstyrene, 4-methylstyrene, 2-ethylstyrene, 3-ethylstyrene, 4-ethylstyrene), halogenated styrenes (e.g., 2-chlorostyrene, 3-chlorostyrene, 4-chlorostyrene), and vinylnaphthalenes. The styrene-based monomer may be used alone or in combination of two or more.

Among these, the styrene-based monomer is preferably styrene in view of reactivity, ease in reaction control, and availability.

Specific examples of the (meth)acrylic monomer include (meth)acrylic acids and (meth)acrylic acid esters. Examples of (meth)acrylic acid esters include (meth)acrylic acid alkyl esters (e.g., methyl (meth)acrylate, ethyl (meth)acrylate, n-propyl (meth)acrylate, n-butyl (meth)acrylate, n-pentyl (meth)acrylate, n-hexyl acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth) acrylate, n-hexadecyl (meth)acrylate, n-octadecyl (meth) acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth) acrylate, isoheptyl (meth)acrylate, isooctyl (meth)acrylate, 2-ethylhexyl (meth)acrylate, cyclohexyl (meth)acrylate, t-butylcyclohexyl (meth)acrylate), (meth)acrylic acid aryl esters (e.g., phenyl (meth)acrylate, biphenyl (meth)acrylate, diphenylethyl (meth)acrylate, t-buthylphenyl (meth)acrylate, terphenyl (meth)acrylate), dimethylaminoethyl (meth) acrylate, diethylaminoethyl (meth)acrylate, methoxyethyl (meth)acylate, 2-hydroxyethyl (meth)acrylate, α-carboxyethyl (meth)acrylate, and (meth)acrylamide. These (meth) acrylic monomers may be used alone or in combination of two or more.

Among these (meth)acrylic acid esters in the (meth) acrylic monomers, (meth)acrylic acid esters having an alkyl group with 2 or more and 14 or less carbon atoms (preferably 2 or more and 10 or less carbon atoms, more preferably 3 or more and 8 or less carbon atoms) are preferred in view of fixability.

In particular, n-butyl (meth)acrylate is preferred, and n-butyl acrylate is particularly preferred.

The copolymerization ratio of the styrene-based monomer to the (meth)acrylic monomer (styrene-based monomer/(meth)acrylic monomer on mass basis) is not limited, but may be from 85/15 to 70/30.

The styrene-acrylic resin may have a crosslinked structure to eliminate or reduce image defects. Examples of the styrene-acrylic resin having a crosslinked structure include a copolymer of at least a styrene-based monomer, a (meth) acrylic monomer, and a crosslikable monomer.

Examples of the crosslikable monomer include bi functional or higher functional crosslinkers.

Examples of bifunctional crosslinkers include divinylbenzene, divinylnaphthalene, di(meth)acrylate compounds (e.g., diethylene glycol di(meth)acrylate, methylene bis (meth)acrylamide, decanediol diacrylate, glycidyl (meth) acrylate), polyester di(meth)acrylate, and 2-([1'-methylpropylideneamino]carboxyamino)ethyl methacrylate.

Examples of polyfunctional crosslinkers include tri(meth) acrylate compounds (e.g., pentaerythritol tri(meth)acrylate, trimethylolethane tri(meth)acrylate, trimethylolpropane tri (meth)acrylate), tetra(meth)acrylate compounds (e.g., pentaerythritol tetra(meth)acrylate, oligoester (meth)acrylate), 2,2-bis(4-methacryloxy-polyethoxyphenyl)propane, diallyl phthalate, triallyl cyanurate, triallyl isocyanurate, triallyl trimellitate, and diallyl chlorendate.

To eliminate or reduce image defects and in view of fixability, the crosslikable monomer is preferably a bifunctional or higher functional (meth)acrylate compound, more preferably a bifunctional (meth)acrylate compound, still more preferably a bifunctional (meth)acrylate compound having an alkylene group with 6 to 20 carbon atoms, and yet still more preferably a bifunctional (meth)acrylate compound having a straight-chain alkylene group with 6 to 20 carbon atoms.

The copolymerization ratio of the crosslikable monomer to the total monomers (crosslikable monomer/total monomers on mass basis) is not limited, but may be from 2/1,000 to 20/1,000.

The glass transition temperature (Tg) of the styrene-acrylic resin is preferably 40° C. or higher and 75° C. or lower, and more preferably 50° C. or higher and 65° C. or lower in view of fixability.

The glass transition temperature is determined from the DSC curve obtained by differential scanning calorimetry (DSC) and, more specifically, determined in accordance with "extrapolated glass transition onset temperature" described in the method for determining the glass transition temperature in JIS K 7121-1987 "Testing Methods for Transition Temperatures of Plastics".

In view of storage stability, the weight-average molecular weight of the styrene-acrylic resin is preferably 5,000 or more and 200,000 or less, more preferably 10,000 or more and 100,000 or less, and still more preferably 20,000 or more and 80,000 or less.

The method for producing the styrene-acrylic resin is not limited and is any of various types of polymerization methods (e.g., solution polymerization, precipitation polymerization, suspension polymerization, bulk polymerization, emulsion polymerization). The polymerization reaction is carried out by using a known process (e.g., a batch process, a semi-continuous process, or a continuous process).

The binder resin other than styrene-acrylic resin may be a polyester resin. Examples of the polyester resin include polycondensation polymers of a polycarboxylic acid and a polyhydric alcohol.

Examples of the polycarboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, naphthalene dicarboxylic acid), anhydrides thereof, and lower (e.g., 1 or more and 5 or less carbon atoms) alkyl esters thereof. Among these, the polycarboxylic acid is preferably, for example, at least an aliphatic dicarboxylic acid, an anhydride thereof, or a lower alkyl ester thereof, and more preferably an aliphatic dicarboxylic acid, an anhydride thereof, or a lower alkyl ester thereof, and an aromatic dicarboxylic acid, an anhydride thereof, or a lower alkyl ester thereof.

The polycarboxylic acid may be a combination of a dicarboxylic acid and a trivalent or higher valent carboxylic acid having a crosslinked structure or branched structure. Examples of the trivalent or higher valent carboxylic acid include trimellitic acid, pyromellitic acid, anhydrides thereof, and lower (e.g., 1 or more and 5 or less carbon atoms) alkyl esters thereof.

The polycarboxylic acid may be used alone or in combination of two or more.

Examples of the polyhydric alcohol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexane dimethanol, hydrogenated bisphenol A), aromatic diols (e.g., an ethylene oxide adduct of bisphenol A, and a propylene oxide adduct of bisphenol A). Among these, the polyhydric alcohol is preferably, for example, an aliphatic diol or an alicyclic diol, and more preferably an aliphatic diol.

The polyhydric alcohol may be a combination of a diol and a trihydric or higher polyhydric alcohol having a crosslinked structure or branched structure. Examples of the trihydric or higher polyhydric alcohol include glycerol, trimethylolpropane, and pentaerythritol.

The polyhydric alcohol may be used alone or in combination of two or more.

The glass transition temperature (Tg) of the polyester resin is preferably 50° C. or higher and 80° C. or lower, and more preferably 50° C. or higher and 65° C. or lower.

The glass transition temperature is determined from the DSC curve obtained by differential scanning calorimetry (DSC) and, more specifically, determined in accordance with "extrapolated glass transition onset temperature" described in the method for determining the glass transition temperature in JIS K 7121-1987 "Testing Methods for Transition Temperatures of Plastics".

To reduce gloss unevenness, the weight-average molecular weight (Mw) of the polyester resin is preferably 5,000 or more and 1,000,000 or less, more preferably 7,000 or more and 500,000 or less, and still more preferably 50,000 or more and 200,000 or less. The number-average molecular weight (Mn) of the polyester resin is preferably 2,000 or more and 100,000 or less. The molecular weight distribution Mw/Mn of the polyester resin is preferably 1.5 or more and 100 or less, and more preferably 2 or more and 60 or less.

The weight-average molecular weight and the number-average molecular weight of the binder resin is determined by gel permeation chromatography (GPC). The determination of the molecular weight by GPC is carried out using HLC-8120GPC, which is a GPC available from Tosoh Corporation and used as a measurement system, TSKgel SuperHM-M (15 cm), which is a column available from Tosoh Corporation, and a THF solvent. The weight-average molecular weight and the number-average molecular weight are calculated from the molecular weight calibration curve created on the basis of the obtained measurement results using a monodisperse polystyrene standard.

The polyester resin is produced by using a known production method. Specifically, the polyester resin is produced by using a method involving causing reaction at a polymerization temperature of 180° C. or higher and 230° C. or lower in a reaction system, if necessary, under reduced pressure while water and alcohol generated during condensation are removed.

If the monomers serving as raw materials do not dissolve or are not compatible with each other at a reaction temperature, a solvent with a high boiling point may be added as a solubilizer to cause dissolution. In this case, the polycondensation reaction is carried out while the solubilizer is distilled off. If a monomer with poor compatibility is present, the monomer with poor compatibility is previously subjected to condensation with an acid or alcohol that is to undergo polycondensation with the monomer, and the condensate is then subjected to polycondensation with a main component.

The amount of the binder resin is preferably 40 mass % or more and 95 mass % or less, more preferably 50 mass % or more and 90 mass % or less, and still more preferably 60 mass % or more and 85 mass % or less with respect to the total amount of the toner particles.

The amount of the binder resin when the toner particles are white toner particles is preferably 30 mass % or more and 85 mass % or less, and more preferably 40 mass % or more and 60 mass % or less with respect to the total amount of the white toner particles.

Release Agent

Examples of the release agent include hydrocarbon waxes; natural waxes, such as carnauba wax, rice wax, and candelilla wax; synthetic or mineral and petroleum waxes, such as montan wax; and ester waxes, such as waxes of fatty acid esters and montanic acid esters. The release agent is not limited to these.

To eliminate or reduce image defects, the melting temperature (Tm) of the release agent is preferably 50° C. or higher and 110° C. or lower, more preferably 70° C. or higher and 100° C. or lower, still more preferably 75° C. or higher and 95° C. or lower, and yet still more preferably 85° C. or higher and 95° C. or lower.

The melting temperature of the release agent is determined from the DSC curve obtained by differential scanning calorimetry (DSC) in accordance with "melting peak temperature" described in the method for determining the melting temperature in JIS K 7121-1987 "Testing Methods for Transition Temperatures of Plastics".

For the electrostatic charge image development toner according to this exemplary embodiment, a difference in endothermic peak temperature of the release agent between first temperature rising and second temperature rising in differential scanning calorimetric analysis is preferably 7° C. or less, more preferably 5° C. or less, and still more preferably 3° C. or less, to reduce gloss unevenness.

The differential scanning calorimetric analysis in this exemplary embodiment is performed by using a differential scanning calorimeter (DSC-60A available from Shimadzu Corporation) in accordance with ASTM D 3418-8. Temperature calibration of the detector in the device is performed using the melting point of indium and zinc, and calibration for the amount of heat is performed using the heat of fusion of indium. An aluminum pan is used as a sample pan, and an empty pan is set as reference. The heating rate is 10° C./min. A difference in endothermic peak temperature of the release agent between the first and second measurement results is calculated, where the first measurement involves heating from room temperature (10° C. or higher and 30° C. or lower) to 150° C., and the second measurement involves, after cooling to 0° C. at 10° C./min, heating to 150° C. again at 10° C./min.

The amount of the release agent is preferably 1 mass % or more and 20 mass % or less, and more preferably 5 mass % or more and 15 mass % or less with respect to the total amount of the toner particles.

Coloring Agent

Examples of the coloring agent include pigments, such as carbon black, chrome yellow, hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, malachite green oxalate, titanium oxide, zinc oxide, calcium carbonate, basic lead carbonate, zinc sulfide-barium sulfate mixture, zinc sulfide, silicon dioxide, and aluminum oxide; and dyes, such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

In the case where the toner particles are white toner particles, the coloring agent may be a white pigment.

The white pigment is preferably titanium oxide or zinc oxide, and more preferably titanium oxide.

The coloring agent may be used alone or in combination of two or more.

The coloring agent may be a coloring agent with the surface treated if necessary and may be used in combination with a dispersant.

The amount of the coloring agent is preferably 1 mass % or more and 30 mass % or less, and more preferably 3 mass % or more and 15 mass % or less with respect to the total amount of the toner particles.

The amount of the white pigment in the case where the toner particles are white toner particles is preferably 15 mass % or more and 70 mass % or less, and more preferably 20 mass % or more and 60 mass % or less with respect to the total amount of the white toner particles.

Other Additives

Examples of other additives include known additives, such as magnetic substances, charge control agents, and inorganic powders. These additives are internal additives and contained in the toner particles.

Properties of Toner Particles and Like

The toner particles may be toner particles having a single-layer structure, or may be toner particles having so-called a core-shell structure including a core part (core particle) and a coating layer (shell layer) covering the core part. The toner particles having a core-shell structure include, for example, a core part containing a binder resin and, if necessary, a coloring agent, a release agent, and the like; and a coating layer containing a binder resin.

The volume-average particle size (D50v) of the toner particles is preferably 2 μm or more and 10 μm or less, and more preferably 4 μm or more and 8 μm or less.

The volume-average particle size of the toner particles is measured by using Coulter Multisizer II (available from Beckman Coulter, Inc.) and the electrolyte ISOTON-II (available from Beckman Coulter, Inc.).

Before measurement, 0.5 mg or more and 50 mg or less of a test sample is added to 2 ml of a 5 mass % aqueous solution of a surfactant (e.g., sodium alkylbenzene sulfonate) serving as a dispersant. The mixture is added to 100 ml or more and 150 ml or less of the electrolyte.

The electrolyte in which the sample is suspended is subjected to a dispersion treatment with an ultrasonic disperser for 1 minute, and the particle size of particles having a particle size in the range of 2 μm or more and 60 μm or less is measured by Coulter Multisizer II with an aperture having a diameter of 100 μm. The number of particles sampled is 50,000.

The volume-based cumulative distribution of the measured particle size is drawn from the smaller particle size side, and the particle size at a cumulative percentage of 50% is defined as a volume-average particle size D50v.

The average circularity of the toner particles in this exemplary embodiment is not limited but preferably 0.91 or more and 0.98 or less, more preferably 0.94 or more and 0.98 or less, and still more preferably 0.95 or more and 0.97 or less to improve the ability to clean the toner from the image holding body.

The circularity of a toner particle in this exemplary embodiment is (the circumference of a circle having an area equal to the area of the projected particle image)/(the circumference of the projected particle image). The average circularity of the toner particles is the circularity at a cumulative percentage of 50% from the smaller circularity side in the distribution of circularity. The average circularity of the toner particles is determined by analyzing at least 3,000 toner particles with a flow particle image analyzer.

In the case where, for example, the toner particles are produced by using the aggregation-coalescence method, the average circularity of the toner particles may be controlled by adjusting the stirring speed of the dispersion, the temperature of the dispersion, or the retention time in the fusion-coalescence step.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surfaces of the inorganic particles serving as an external additive may be hydrophobized. The hydrophobization treatment is performed by, for example, immersing the inorganic particles in a hydrophobizing agent. Examples of the hydrophobizing agent include, but are not limited to, a silane coupling agent, a silicone oil, a titanate coupling agent, and an aluminum coupling agent. These hydrophobizing agents may be used alone or in combination of two or more.

The amount of the hydrophobizing agent is, for example, 1 part by mass or more and 10 parts by mass or less per 100 parts by mass of the inorganic particles.

Examples of the external additive also include resin particles (resin particles formed of, for example, polystyrene, polymethyl methacrylate (PMMA), and melamine resin), and cleaning active agents (e.g., higher fatty acid metal salts represented by zinc stearate, particles of fluorocarbon polymers).

The amount of the external additive externally added is, for example, 0.01 mass % or more and 10 mass % or less, and more preferably 0.01 mass % or more and 6 mass % or less with respect to the amount of the toner particles.

Method for Producing Toner

Next, a method for producing a toner according to this exemplary embodiment will be described below.

The toner according to this exemplary embodiment is obtained by externally adding an external additive to toner particles after production of the toner particles.

The toner particles may be produced by using any one of dry production methods (e.g., kneading-pulverization method) and wet production methods (e.g., aggregation-coalescence method, suspension-polymerization method, and dissolution-suspension method). The method is not limited to these production methods, and a known production method is employed. Among these methods, the toner particles are preferably produced by using an aggregation-coalescence method.

Specifically, for example, when the toner particles are produced by using an aggregation-coalescence method, the toner particles are produced through the following steps: a step (resin particle dispersion preparing step) of preparing a resin particle dispersion in which resin particles serving as a binder resin are dispersed; a step (aggregated particle forming step) of aggregating the resin particles (and other particles if necessary) in the resin particle dispersion (in a dispersion obtained by mixing the resin particle dispersion with other particle dispersion if necessary) to form aggregated particles; and a step (fusion-coalescence step) of heating an aggregated particle dispersion in which the aggregated particles are dispersed, to cause fusion and coalescence of the aggregated particles and thus to form toner particles.

Each step will be described below in detail.

The following description provides a method for producing toner particles containing a coloring agent and a release agent, but the coloring agent and the release agent are used if necessary. It is understood that additives other than the coloring agent and the release agent may be used.

Resin Particle Dispersion Preparing Step

In addition to a resin particle dispersion in which resin particles serving as a binder resin are dispersed, for example, a coloring agent particle dispersion in which coloring agent particles are dispersed, and a release agent particle dispersion in which release agent particles are dispersed are prepared.

The resin particle dispersion is prepared by, for example, dispersing resin particles in a dispersion medium using a surfactant.

Examples of the dispersion medium used in the resin particle dispersion include aqueous media.

Examples of aqueous media include water such as distilled water and ion exchange water and alcohols. These aqueous media may be used alone or in combination of two or more.

Examples of the surfactant include anionic surfactants, such as sulfate-based surfactants, sulfonate-based surfactants, phosphate-based surfactants, and soap-based surfactants; cationic surfactants, such as amine salt-based surfactants and quaternary ammonium salt-based surfactants; and nonionic surfactants, such as polyethylene glycol-based surfactants, alkylphenol ethylene oxide adduct-based surfactants, and polyhydric alcohol-based surfactants. Among these surfactants, in particular, anionic surfactants and cationic surfactants may be used. A nonionic surfactant may be used in combination with an anionic surfactant or a cationic surfactant.

The surfactant may be used alone or in combination of two or more.

Examples of a method for dispersing resin particles in a dispersion medium to prepare the resin particle dispersion include ordinary dispersion methods using a rotary shear homogenizer, a ball mill having media, a sand mill, and Dyno-Mill. Depending on the type of resin particles, the resin particles may be dispersed in the dispersion medium by a phase-inversion emulsification method. The phase-inversion emulsification method is a method for dispersing a resin in the form of particles in an aqueous medium. This method involves dissolving a target resin in a hydrophobic organic solvent capable of dissolving the resin; adding a base to the organic continuous phase (O phase) to cause neutralization; and then adding an aqueous medium (W phase) to cause phase inversion from W/O to O/W.

The volume-average particle size of the resin particles dispersed in the resin particle dispersion is preferably, for example, 0.01 μm or more and 1 μm or less, more preferably 0.08 μm or more and 0.8 μm or less, and still more preferably 0.1 μm or more and 0.6 μm or less.

The volume-average particle size of the resin particles is determined as follows: drawing the volume-based cumulative distribution in divided particle size ranges (channels) from the smaller particle size side using the particle size distribution obtained by measurement with a laser diffraction particle size distribution measuring device (e.g., LA-700, available from Horiba Ltd.); and defining the particle size at a cumulative percentage of 50% with respect to all particles as a volume-average particle size D50v. The volume-average particle size of particles in other dispersions is determined similarly.

The amount of the resin particles in the resin particle dispersion is preferably 5 mass % or more and 50 mass % or less, and more preferably 10 mass % or more and 40 mass % or less.

Similarly to the resin particle dispersion, for example, the coloring agent particle dispersion and the release agent particle dispersion are also prepared. Specifically, the description of the volume-average particle size of the particles, the dispersion medium, the dispersion method, and the amount of the particles for the resin particle dispersion is applied to the coloring agent particles dispersed in the coloring agent particle dispersion and the release agent particles dispersed in the release agent particle dispersion.

Aggregated Particle Forming Step

Next, the resin particle dispersion is mixed with the coloring agent particle dispersion and the release agent particle dispersion. The resin particles, the coloring agent particles, and the release agent particles cause hetero-aggregation in the mixture dispersion to form aggregated particles having a size close to the intended toner particle size and containing the resin particles, the coloring agent particles, and the release agent particles.

Specifically, the aggregated particles are formed, for example, as follows: adding a flocculant to the mixture dispersion and adjusting the pH of the mixture dispersion to the acid side (e.g., pH 2 or higher and pH 5 or lower), and if necessary, adding a dispersion stabilizer; and then heating the mixture dispersion to a temperature close to the glass transition temperature of the resin particles (specifically, heating to, for example, the glass transition temperature of the resin particles minus 30° C. or higher and the glass transition temperature minus 10° C. or lower) to cause aggregation of the particles dispersed in the mixture dispersion.

The aggregated particle forming step may involve, for example, adding a flocculant to the mixture dispersion at room temperature (e.g., 25° C.) under stirring with a rotary shear homogenizer and adjusting the pH of the mixture dispersion to the acid side (e.g., pH 2 or higher and pH 5 or lower), and heating the mixture dispersion after addition of a dispersion stabilizer if necessary.

Examples of the flocculant include surfactants having polarity opposite to the polarity of the surfactant contained in the mixture dispersion, inorganic metal salts, and divalent or higher valent metal complexes. The use of a metal complex as a flocculant reduces the amount of the surfactant used and improves charging characteristics.

The flocculant may be used in combination with an additive that forms a complex or a similar bond with metal ions of the flocculant, if necessary. The additive may be a chelating agent.

Examples of inorganic metal salts include metal salts, such as calcium chloride, calcium nitrate, barium chloride, magnesium chloride, zinc chloride, aluminum chloride, and aluminum sulfate; and inorganic metal salt polymers, such as polyaluminum chloride, polyaluminum hydroxide, and calcium polysulfide.

The chelating agent may be a water-soluble chelating agent. Examples of the chelating agent include oxycarboxylic acids, such as tartaric acid, citric acid, and gluconic acid; and aminocarboxylic acids, such as iminodiacetic acid (IDA), nitrilotriacetic acid (NTA), and ethylenediaminetetraacetic acid (EDTA).

To reduce gloss unevenness, aluminum salts are preferred, and polyaluminum chloride are more preferred among these substances in this exemplary embodiment.

To reduce gloss unevenness, the amount of the flocculant added, preferably, the amount of an aluminum salt added, is preferably 0.01 parts by mass or more and 20 parts by mass or less, more preferably 6 parts by mass or more and 20 parts by mass or less, still more preferably 8 parts by mass or more and 18 parts by mass or less, and yet still more preferably 10 parts by mass or more and 16 parts by mass or less per 100 parts by mass of the resin particles.

In an aspect of this exemplary embodiment, as described above, a large amount of an aluminum salt is used to reduce gloss unevenness. However, a large amount of the aluminum salt may affect toner particle size control and may result in a large amount of coarse powder.

In view of toner particle size control, the surfactant may be added in an amount greater than or equal to the number of moles of the aluminum salt. The surfactant may act as a trapping agent or inhibitor for the aluminum salt and thus may facilitate toner particle size control.

In the case where the electrostatic charge image development toner according to this exemplary embodiment is core-shell toner, the amount of resin in the resin particle dispersion for forming the shell may be greater than the amount of resin in the resin particle dispersion for forming the core in the aggregated particle forming step to reduce gloss unevenness. The shell with a larger thickness may improve the elasticity of the toner and may reduce viscosity differences according to temperature. The obtain images thus have less gloss unevenness.

Fusion-Coalescence Step

Next, the aggregated particle dispersion in which the aggregated particles are dispersed is heated to, for example, a temperature not lower than the glass transition temperature of the resin particles (e.g., a temperature not lower than a temperature higher than the glass transition temperature of the resin particles by 30° C. to 50° C.) and not lower than the melting temperature of the release agent to cause fusion and coalescence of the aggregated particles and thus to form toner particles.

In the fusion-coalescence step, the resin and the release agent are melted at a temperature not lower than the glass transition temperature of the resin particles and not lower than the melting temperature of the release agent. Then, cooling is performed to provide toner.

The aspect ratio of the release agent domains in the toner can be controlled by maintaining the temperature around the solidifying point of the release agent for a given time during cooling to grow crystals or by using two or more release agents with different melting temperatures to accelerate crystal growth during cooling.

The toner particles are produced through the above-described steps.

The toner particles may be produced through the following steps: a step of preparing an aggregated particle dispersion in which aggregated particles are dispersed, and then mixing the aggregated particle dispersion and a resin particle dispersion in which resin particles are dispersed, to cause aggregation such that the resin particles are attached to the surfaces of the aggregated particles and thus to form secondary aggregated particles; and a step of heating a secondary aggregated particle dispersion in which the secondary aggregated particles are dispersed, to cause fusion and coalescence of the secondary aggregated particles and thus to form toner particles having a core-shell structure.

After completion of the fusion-coalescence step, the toner particles formed in the dispersion are subjected to a known washing step, a known solid-liquid separation step, and a known drying step to provide dry toner particles. The washing step may involve sufficient displacement washing with ion exchange water in view of charging characteristics. The solid-liquid separation step may involve, for example, suction filtration or pressure filtration in view of productivity. The drying step may involve, for example, freeze drying, flush drying, fluidized bed drying, or vibratory fluidized bed drying in view of productivity.

The toner according to this exemplary embodiment is produced by, for example, adding an external additive to the obtained dry toner particles and mixing them. Mixing may be performed with, for example, a V-blender, a Henschel mixer, or a Lodige mixer. In addition, coarse particles in the toner may be removed with, for example, a vibratory screening machine, or a wind-power screening machine, if necessary.

Electrostatic Charge Image Developer

The electrostatic charge image developer according to this exemplary embodiment contains at least the toner according to this exemplary embodiment. The electrostatic charge image developer according to this exemplary embodiment may be a one-component developer containing only the toner according to this exemplary embodiment, or may be a two-component developer formed by mixing the toner and a carrier.

The carrier is not limited, and may be any known carrier. Examples of the carrier include a coated carrier in which the surfaces of cores formed of magnetic powder is coated with resin; a magnetic powder-dispersed carrier in which magnetic powder is dispersed in a matrix resin; and a resin-impregnated carrier in which porous magnetic powder is impregnated with resin. The magnetic powder-dispersed carrier and the resin-impregnated carrier may be carriers in which the surfaces of carrier-forming particles serving as cores are coated with resin.

Examples of the magnetic powder include powders made of magnetic metals, such as iron, nickel, and cobalt; and powders made of magnetic oxides, such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, a straight silicone resin including an organosiloxane bond, and modified products thereof, fluorocarbon resin, polyester, polycarbonate, phenolic resin, and epoxy resin. The coating resin and the matrix resin may contain additives, such as conductive particles. Examples of the conductive particles include particles made of metals, such as gold, silver, and copper; and particles made of carbon black, titanium oxide, zinc oxide, tin oxide, barium sulfate, aluminum borate, and potassium titanate.

To coat the surfaces of cores with resin, for example, a coating method using a coating-layer forming solution in which a coating resin and various additives (if necessary) are dissolved in an appropriate solvent is used. The solvent is not limited and may be selected in consideration of the type of resin used, coating suitability, and the like. Specific examples of the resin coating method include an immersion method that involves immersing the cores in a coating-layer forming solution; a spray method that involves spraying a coating-layer forming solution onto the surfaces of the cores; a fluidized bed method that involves spraying a coating-layer forming solution to the cores while the cores are floating in air flow; and a kneader-coater method that involves mixing the cores of a carrier and a coating-layer forming solution in a kneader-coater, and then removing a solvent.

The mixing ratio (mass ratio) of the toner to the carrier in the two-component developer is preferably from 1:100 to 30:100 (=toner:carrier), and more preferably from 3:100 to 20:100.

Image Forming Apparatus and Image Forming Method

An image forming apparatus and an image forming method according to this exemplary embodiment will be described.

The image forming apparatus according to this exemplary embodiment includes an image holding body; a charging unit that charges the surface of the image holding body; an electrostatic charge image forming unit that forms an electrostatic charge image on the charged surface of the image holding body; a developing unit that contains an electrostatic charge image developer and develops the electrostatic charge image on the surface of the image holding body by using the electrostatic charge image developer to form a toner image; a transfer unit that transfers the toner image on the surface of the image holding body onto the surface of a recording medium; and a fixing unit that fixes the toner image that has been transferred onto the surface of the recording medium. The electrostatic charge image developer according to this exemplary embodiment is used as an electrostatic charge image developer.

An image forming method (an image forming method according to this exemplary embodiment) performed in the image forming apparatus according to this exemplary embodiment includes a charging step of charging the surface of the image holding body; an electrostatic charge image forming step of forming an electrostatic charge image on the charged surface of the image holding body; a developing step of developing the electrostatic charge image on the surface of the image holding body by using the electrostatic charge image developer according to this exemplary embodiment to form a toner image; a transferring step of transferring the toner image on the surface of the image holding body onto the surface of a recording medium; and a fixing step of fixing the toner image that has been transferred onto the surface of the recording medium.

The image forming apparatus according to this exemplary embodiment may be a known image forming apparatus, such as a direct transfer-type apparatus in which a toner image formed on the surface of an image holding body is directly transferred onto a recording medium; an intermediate transfer-type apparatus in which a toner image formed on the surface of an image holding body is firstly transferred onto the surface of an intermediate transfer body, and the toner image, which has been transferred onto the surface of the intermediate transfer medium, is secondarily transferred onto the surface of a recording medium; an apparatus including a cleaning unit that cleans the surface of an image holding body before charging after transfer of a toner image; and an apparatus including a static eliminating unit that eliminates static by irradiating the surface of an image holding body with static eliminating light before charging after transfer of a toner image.

In the case where the image forming apparatus according to this exemplary embodiment is an intermediate transfer-type apparatus, the transfer unit includes, for example, an intermediate transfer body having the surface onto which a toner image is transferred, a first transfer unit that firstly transfers the toner image on the surface of the image holding body onto the surface of the intermediate transfer body, and a second transfer unit that secondarily transfers the toner image, which has been transferred onto the surface of the intermediate transfer body, onto the surface of a recording medium.

In the image forming apparatus according to this exemplary embodiment, a section including the developing unit may have a cartridge structure (process cartridge) that is attachable to and detachable from the image forming apparatus. The process cartridge may be a process cartridge including a developing unit that contains the electrostatic charge image developer according to this exemplary embodiment.

An example of the image forming apparatus according to this exemplary embodiment will be described below, but the image forming apparatus is not limited to this example. In the following description, the main parts illustrated in the figure are described, and the description of other parts is omitted.

FIG. 1 is a schematic view of the image forming apparatus according to this exemplary embodiment.

The image forming apparatus illustrated in FIG. 1 includes first to fourth image forming units 10Y, 10M, 10C, and 10K (image forming parts), which respectively output yellow (Y), magenta (M), cyan (C), and black (K) color images based on color-separated image data. The image forming units (hereinafter may also be referred to simply as "units") 10Y, 10M, 10C, and 10K are spaced apart from each other at predetermined intervals in the horizontal direction. The units 10Y, 10M, 10C, and 10K may be process cartridges that are attachable to and detachable from the image forming apparatus.

An intermediate transfer belt (an example of the intermediate transfer body) 20 is located above and in upper parts of the units 10Y, 10M, 10C, and 10K. The intermediate transfer belt 20 extends so as to pass through the units 10Y, 10M, 10C, and 10K. The intermediate transfer belt 20 is wound around a drive roller 22 and a support roller 24, which are in contact with the inner surface of the intermediate transfer belt 20, and runs in the direction from the first unit 10Y toward the fourth unit 10K. A force is applied to the support roller 24 in a direction away from the drive roller 22 by means of a spring or the like (not illustrated), so that tension is applied to the intermediate transfer belt 20 wound around both the support roller 24 and the drive roller 22. An intermediate transfer belt cleaning device 30 is disposed adjacent to the image holding surface of the intermediate transfer belt 20 so as to face the drive roller 22.

Yellow toner, magenta toner, cyan toner, and black toner in the respective toner cartridges 8Y, 8M, 8C, and 8K are supplied to the respective developing devices (examples of developing units) 4Y, 4M, 4C, and 4K of the units 10Y, 10M, 10C, and 10K.

Since the first to fourth units 10Y, 10M, 10C, and 10K have the same structure and operate in the same manner, the first unit 10Y disposed upstream in the running direction of the intermediate transfer belt to form a yellow image will be representatively described.

The first unit 10Y has a photoreceptor 1Y that functions as an image holding body. The photoreceptor 1Y is surrounded by, in sequence, a charging roller (an example of the charging unit) 2Y that charges the surface of the photoreceptor 1Y to a predetermined potential, an exposure device (an example of the electrostatic charge image forming unit) 3 that exposes the charged surface to a laser beam 3Y based on a color-separated image signal to form an electrostatic charge image, a developing device (an example of the developing unit) 4Y that supplies charged toner to the electrostatic charge image to develop the electrostatic charge image, a first transfer roller (an example of the first transfer unit) 5Y that transfers the developed toner image onto the intermediate transfer belt 20, and a photoreceptor cleaning device (an example of the image holding body cleaning unit) 6Y that removes residual toner from the surface of the photoreceptor 1Y after the first transfer.

The first transfer roller 5Y is disposed on the inner side of the intermediate transfer belt 20 so as to face the photoreceptor 1Y. The first transfer rollers 5Y, 5M, 5C, and 5K in the units are connected to the respective bias power supplies (not illustrated) that apply a first transfer bias. The transfer bias applied by each bias power supply to the corresponding first transfer roller changes under the control of a controller (not illustrated).

The operation of the first unit 10Y in forming a yellow image will be described below.

Before operation, the charging roller 2Y charges the surface of the photoreceptor 1Y to a potential of from −600 V to −800 V.

The photoreceptor 1Y includes a conductive substrate (e.g., with a volume resistivity of $1\times10^{-6}$ Ωcm or less at 20° C.) and a photosensitive layer stacked on the substrate. The photosensitive layer normally has high resistance (comparable to the resistance of common resins), but irradiation with a laser beam changes the specific resistance of a region of the photosensitive layer irradiated with the laser beam. For this, the charged surface of the photoreceptor 1Y is irradiated with the laser beam 3Y from the exposure device 3 in accordance with yellow image data sent from the controller (not illustrated). As a result, an electrostatic charge image with a yellow image pattern is formed on the surface of the photoreceptor 1Y.

The electrostatic charge image is an image formed on the surface of the photoreceptor 1Y by means of charging. Specifically, the electrostatic charge image is so-called a negative latent image formed such that the specific resistance of a region of the photosensitive layer irradiated with the laser beam 3Y drops to cause flow of charges on the surface of the photoreceptor 1Y while charges in a region that is not irradiated with the laser beam 3Y remain.

The electrostatic charge image formed on the photoreceptor 1Y rotates up to a predetermined developing position as the photoreceptor 1Y runs. The electrostatic charge image on the photoreceptor 1Y is developed and visualized by the developing device 4Y to form a toner image at this developing position.

The developing device 4Y contains, for example, an electrostatic charge image developer including at least yellow toner and a carrier. The yellow toner is triboelectrically charged upon being stirred inside the developing device 4Y so as to have charges with the same polarity (negative polarity) as charges on the photoreceptor 1Y. The yellow toner is held on a developer roller (an example of a developer holding body). As the surface of the photoreceptor 1Y passes through the developing device 4Y, the yellow toner is electrostatically attached to a latent image part from which static has been eliminated and which is located on the surface of the photoreceptor 1Y, whereby the latent image is developed with the yellow toner. The photoreceptor 1Y having the yellow toner image formed thereon subsequently runs at a predetermined rate, and the toner image developed on the photoreceptor 1Y is transported to a predetermined first transfer position.

When the yellow toner image on the photoreceptor 1Y is transported to the first transfer position, a first transfer bias is applied to the first transfer roller 5Y, an electrostatic force from the photoreceptor 1Y toward the first transfer roller 5Y acts on the toner image, and the toner image on the photoreceptor 1Y is transferred onto the intermediate transfer belt 20. The transfer bias applied at this time has polarity (+) opposite to the polarity (−) of the toner. The transfer bias is controlled at, for example, +10 μA in the first unit 10Y by the controller (not illustrated). The toner remaining on the photoreceptor 1Y is removed and collected by the photoreceptor cleaning device 6Y.

The first transfer biases applied to the first transfer rollers 5M, 5C, and 5K in the second unit 10M and the subsequent units are also controlled in the same manner as in the first unit.

Accordingly, the intermediate transfer belt 20 onto which the yellow toner image has been transferred in the first unit 10Y is transported through the second to fourth units 10M, 10C, and 10K, and the toner images of respective colors are multiply transferred in a superimposed manner.

The intermediate transfer belt 20 onto which the four color toner images have been multiply transferred through the first to fourth units reaches a second transfer section. The second transfer section includes the intermediate transfer belt 20, the support roller 24 in contact with the inner surface of the intermediate transfer belt, and a second transfer roller (an example of the second transfer unit) 26 disposed adjacent to the image holding surface of the intermediate transfer belt 20. A sheet of recording paper (an example of the recording medium) P is fed to a gap between the second transfer roller 26 and the intermediate transfer belt 20 through a feeding mechanism at a predetermined timing, and a second transfer bias is applied to the support roller 24. The transfer bias applied at this time has the same polarity (−) as the polarity (−) of the toner. An electrostatic force from the intermediate transfer belt 20 toward the sheet of recording paper P acts on the toner image, whereby the toner image on the intermediate transfer belt 20 is transferred onto the sheet of recording paper P. The second transfer bias in this case is determined on the basis of the resistance detected by a resistance detector (not illustrated) that detects the resistance of the second transfer section. The voltage for the second transfer bias is controlled.

The sheet of recording paper P onto which the toner image has been transferred is conveyed to a pressure contact part (nip part) between a pair of fixing rollers in a fixing device (an example of the fixing unit) 28. The toner image is thus fixed to the sheet of recording paper P to form a fixed image. The sheet of recording paper P to which the color image has been fixed is discharged to a discharge part, and a series of color image forming operations are completed.

Examples of the recording paper P onto which a toner image is transferred include plain paper used in electrophotographic copiers, printers, and the like. Examples of the recording medium include OHP sheets, in addition to the recording paper P. To improve the smoothness of the image surface after fixation, the recording paper P may have a smooth surface and may be, for example, coated paper obtained by coating the surface of plain paper with resin or the like, art paper for printing, or the like.

Process Cartridge, Toner Cartridge

The process cartridge according to this exemplary embodiment includes a developing unit that contains the electrostatic charge image developer according to this exemplary embodiment and develops an electrostatic charge image on the surface of an image holding body by using the electrostatic charge image developer to form a toner image. The process cartridge according to this exemplary embodiment is attachable to and detachable from an image forming apparatus.

The process cartridge according to this exemplary embodiment may include a developing unit, and if necessary, at least one selected from other units, such as an image holding body, a charging unit, an electrostatic charge image forming unit, and a transfer unit.

An example of the process cartridge according to this exemplary embodiment will be described below, but the process cartridge is not limited to this example. In the following description, the main parts illustrated in the figure are described, and the description of other parts is omitted.

Figure 2:
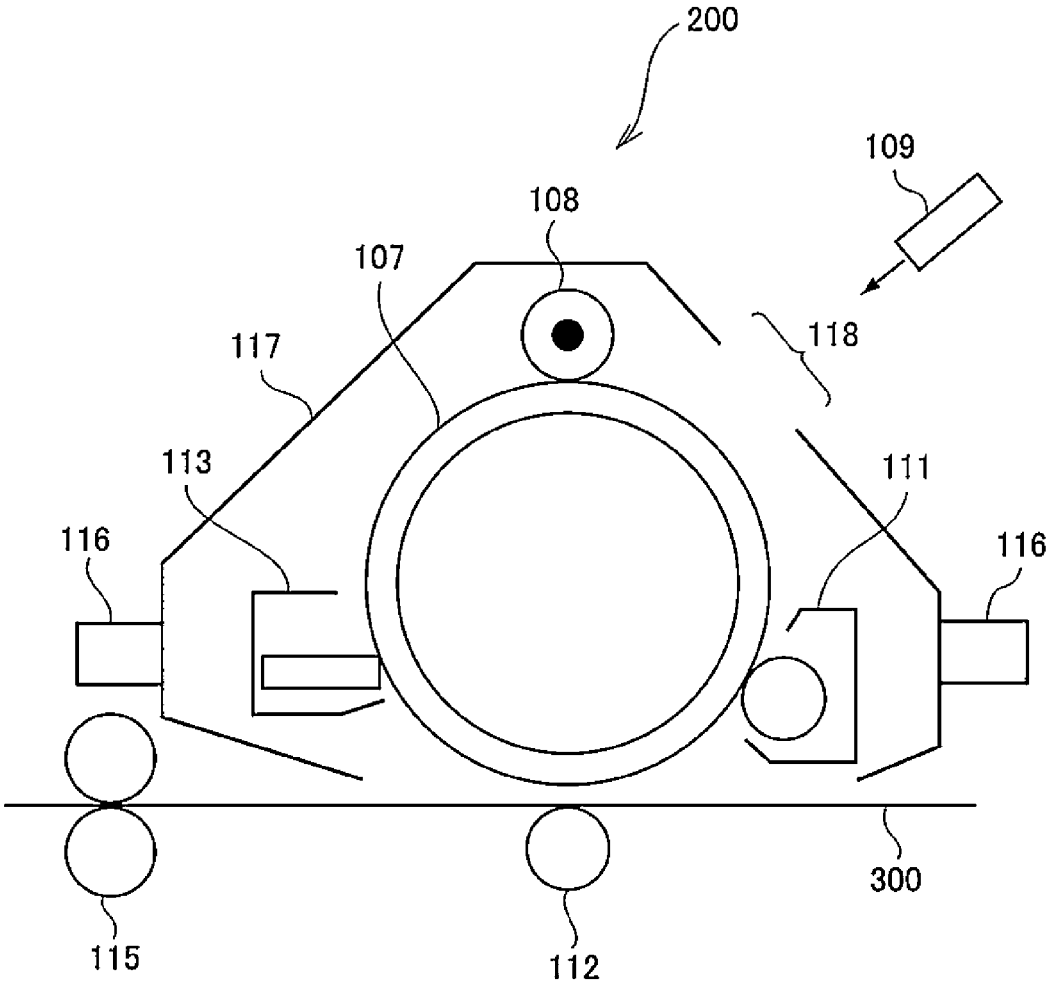
FIG. 2 is a schematic view of a process cartridge according to an exemplary embodiment.

FIG. 2 is a schematic view of an example of the process cartridge according to this exemplary embodiment.

A process cartridge 200 illustrated in FIG. 2 is formed as, for example, a cartridge in which a photoreceptor 107 (an example of the image holding body), a charging roller 108 (an example of the charging unit) on the periphery of the photoreceptor 107, a developing device 111 (an example of the developing unit), and a photoreceptor cleaning device 113 (an example of the cleaning unit) are integrally combined and held together by a housing 117 including installation rails 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a sheet of recording paper (an example of the recording medium).

Next, a toner cartridge according to this exemplary embodiment will be described.

The toner cartridge according to this exemplary embodiment contains the toner according to this exemplary embodiment and is attachable to and detachable from an image forming apparatus. The toner cartridge contains toner for replenishment to be supplied to a developing unit in the image forming apparatus.

The image forming apparatus illustrated in FIG. 1 includes detachable toner cartridges 8Y, 8M, 8C, and 8K. The developing devices 4Y, 4M, 4C, and 4K are connected to the respective color toner cartridges through toner supply tubes (not illustrated). In the case where the toner in the toner cartridges run short, the toner cartridges are replaced.

EXAMPLES

Examples of the present disclosure will be described below, but the present disclosure is not limited to the following Examples. In the following description, the units "part" and "%" are all on the mass basis, unless otherwise specified.

For the toner, the loss modulus G", the maximum endothermic peak temperature, the gel fraction, the Al content, the BET specific surface area, a difference in endothermic peak temperature of the release agent between first temperature rising and second temperature rising in differential scanning calorimetric analysis, the absorbance at given wavelengths, the ½ outflow temperature in the flow tester, and the toluene insoluble matter are measured by using the above-described methods.

Example 1

Preparation of Resin Particle Dispersion

Styrene: 310 parts
n-Butyl acrylate: 100 parts
β-Carboxyethyl acrylate: 9 parts
1,10-Decanediol diacrylate: 3.0 parts
Dodecanethiol: 3 parts In a flask, a solution of 4 parts of an anionic surfactant (Dowfax available from The Dow Chemical Company) in 550 parts of ion exchange water is placed, and a mixture of the above-described materials is added to the solution to form an emulsion. A solution of 6 parts of ammonium persulfate in 50 parts of ion exchange water is added to the emulsion while the emulsion is slowly stirred for 10 minutes. Next, the system is adequately purged with nitrogen and heated to 75° C. in an oil bath to continue emulsion polymerization for 4 hours. This process yields a resin particle dispersion in which resin particles having a weight-average molecular weight of 33,000, a glass transition temperature of 53° C., and a volume-average particle size of 250 nm are dispersed. The solids content of the resin particle dispersion is adjusted to 20 mass % by addition of ion exchange water to provide a resin particle dispersion.

Preparation of Magenta Coloring Agent Dispersion

PR 122 (Chromofine magenta 6887 available from Dainichiseika Color & Chemicals Mfg. Co., Ltd.): 70 parts
Anionic surfactant (Neogen RK available from DKS Co. Ltd.): 1 part
Ion exchange water: 200 parts These materials are mixed and dispersed by using a homogenizer (ULTRA-TURRAX T50 available from IKA) for 10 minutes. The solids content in the dispersion is adjusted to 20 mass % by addition of ion exchange water to provide a coloring agent dispersion in which coloring agent particles having a volume-average particle size of 190 nm are dispersed.

Preparation of Release Agent Dispersion

Paraffin wax (FNP0090 available from Nippon Seiro Co., Ltd.): 100 parts
Anionic surfactant (Neogen RK available from DKS Co. Ltd.): 1 part
Ion exchange water: 350 parts These materials are mixed and heated to 100° C. The mixture is dispersed with a homogenizer (ULTRA-TURRAX T50 available from IKA) and then dispersed with a Manton-Gaulin high-pressure homogenizer (available from Gaulin Corporation) to provide a release agent particle dispersion (solids content: 20 mass %) in which release agent particles having a volume-average particle size of 200 nm are dispersed.

Method for Producing Toner

Ion exchange water: 185 parts

Resin particle dispersion: 105 parts

Magenta colored particle dispersion: 35 parts

Release agent particle dispersion A: 40 parts

Anionic surfactant (Dowfax available from The Dow Chemical Company): 2.8 parts

These components are placed in a reactor equipped with a thermometer, a pH meter, and a stirrer, and maintained at a temperature of 30° C. and a number of stirring revolutions of 150 rpm for 30 minutes while the temperature is externally controlled with a mantle heater.

A PAC aqueous solution of 2.8 parts of polyaluminum chloride (PAC available from Oji Paper Co., Ltd., 30% powder product) in 28 parts of ion exchange water (to increase the aluminum content in the toner) is added while dispersion is achieved with a homogenizer (Ultra-Turrax T50 available from IKA Japan). The temperature is then raised to 50° C., and the particle size is measured with Coulter Multisizer II (aperture diameter: 50 μm, available from Coulter Corporation). The volume-average particle size is 5.0 μm. Subsequently, 120 parts of a resin particle dispersion (changed to the design with a thick shell layer) is additionally added, so that the resin particles are attached to the surfaces of the aggregated particles (shell structure).

Next, 20 parts of a 10 mass % nitrilotriacetic acid (NTA) metal salt aqueous solution (Chelest 70 available from Chelest Corporation) is added, and the pH of the mixture is then adjusted to 9.0 with a 1N (1 mol/L) sodium hydroxide aqueous solution. The mixture is then stirred by using four paddle impellers (impeller diameter/tank diameter ratio (d/D)=0.70) at a stirring speed of 250 rpm, and the mixture is heated to 90° C. at a heating rate of 0.05° C./min and maintained at 90° C. for 3 hours. The mixture is then cooled and filtered to provide coarse toner particles. The coarse toner particles are further repeatedly subjected to redispersion in ion exchange water and filtration, that is, washing, until the electrical conductivity of the filtrate reaches 20 ρS/cm or less. The coarse toner particles are then dried under vacuum in an oven at 40° C. for 5 hours to provide toner particles.

The obtained toner particles (100 parts by mass) are blended with 1.5 parts by mass of hydrophobic silica (RY50 available from Nippon Aerosil Co., Ltd.) and 1.0 part by mass of hydrophobic titanium oxide (T805 available from Nippon Aerosil Co., Ltd.) by using a sample mill at 10,000 rpm for 30 seconds. The mixture is then screened through a vibrating screen with a mesh size of 45 μm to prepare a toner (electrostatic charge image development toner) of Example 1. The obtained toner has a volume-average particle size of 6.1 μm.

Preparation of Carrier

Styrene-methyl methacrylate copolymer: 5 parts (mass ratio (styrene/methyl methacrylate): 70/30)

Toluene: 15 parts

Carbon black (Regal 330 available from Cabot Corporation): 1 part

These components are mixed and stirred with a stirrer for 10 minutes to prepare a coating layer-forming solution. Next, the coating solution and 100 parts of ferrite particles (volume-average particle size: 40 μm) are placed in a vacuum degassing kneader and stirred at 60° C. for 30 minutes. The mixture is further degassed with heating under reduced pressure and dried to prepare a carrier.

Preparation of Electrostatic Charge Image Developer

The toner of Example 1 (8 parts) is mixed with 92 parts of the carrier by using a V-blender to prepare a developer (electrostatic charge image developer) of Example 1.

Comparative Example 1

Preparation of Resin Particle Dispersion

Styrene: 310 parts n-Butyl acrylate: 100 parts

β-Carboxyethyl acrylate: 9 parts 1,10-Decanediol diacrylate: 3.0 parts

Dodecanethiol: 3 parts

In a flask, a solution of 4 parts of an anionic surfactant (Dowfax available from The Dow Chemical Company) in 550 parts of ion exchange water is placed, and a mixture of the above-described materials is added to the solution to form an emulsion. A solution of 6 parts of ammonium persulfate in 50 parts of ion exchange water is added to the emulsion while the emulsion is slowly stirred for 10 minutes. Next, the system is adequately purged with nitrogen and heated to 75° C. in an oil bath to continue emulsion polymerization for 4 hours. This process yields a resin particle dispersion in which resin particles having a weight-average molecular weight of 33,000, a glass transition temperature of 53° C., and a volume-average particle size of 250 nm are dispersed. The solids content of the resin particle dispersion is adjusted to 20 mass % by addition of ion exchange water to provide a resin particle dispersion.

Method for Producing Toner

Ion exchange water: 185 parts

Resin particle dispersion: 130 parts

Magenta colored particle dispersion: 35 parts

Release agent particle dispersion A: 40 parts

Anionic surfactant: 2.8 parts

These components are placed in a reactor equipped with a thermometer, a pH meter, and a stirrer, and maintained at a temperature of 30° C. and a number of stirring revolutions of 150 rpm for 30 minutes while the temperature is externally controlled with a mantle heater.

A PAC aqueous solution of 0.7 parts of PAC (available from Oji Paper Co., Ltd., 30% powder product) in 7 parts of ion exchange water is added while dispersion is achieved with a homogenizer (Ultra-Turrax T50 available from IKA Japan). The temperature is then raised to 50° C., and the particle size is measured with Coulter Multisizer II (aperture diameter: 50 μm, available from Coulter Corporation). The volume-average particle size is 5.0 μm. Subsequently, 93 parts of the resin particle dispersion is additionally added, so that the resin particles are attached to the surfaces of aggregated particles (shell structure).

Next, 20 parts of a 10 mass % nitrilotriacetic acid (NTA) metal salt aqueous solution (Chelest 70 available from Chelest Corporation) is added, and the pH of the mixture is then adjusted to 9.0 with a 1N sodium hydroxide aqueous solution. The mixture is then stirred by using four paddle impellers (d/D=0.50) at a stirring speed of 200 rpm, and the mixture is heated to 90° C. at a heating rate of 0.05° C./min and maintained at 90° C. for 3 hours. The mixture is then cooled and filtered to provide coarse toner particles. The coarse toner particles are further repeatedly subjected to redispersion in ion exchange water and filtration, that is, washing, until the electrical conductivity of the filtrate reaches 20 S/cm or less. The coarse toner particles are then dried under vacuum in an oven at 40° C. for 5 hours to provide toner particles.

The obtained toner particles (100 parts by mass) are blended with 1.5 parts by mass of hydrophobic silica (RY50 available from Nippon Aerosil Co., Ltd.) and 1.0 part by mass of hydrophobic titanium oxide (T805 available from Nippon Aerosil Co., Ltd.) by using a sample mill at 10,000 rpm for 30 seconds. The mixture is then screened through a vibrating screen with a mesh size of 45 μm to prepare a toner (electrostatic charge image development toner) of Comparative Example 1. The obtained toner has a volume-average particle size of 6.1 μm.

Preparation of Electrostatic Charge Image Developer

The toner of Comparative Example 1 (8 parts) is mixed with 92 parts of a carrier by using a V-blender to prepare a developer (electrostatic charge image developer) of Comparative Example 1.

Examples 2 to 13 and Comparative Examples 2 and 3

The electrostatic charge image development toners of Examples 2 to 13 and Comparative Examples 2 and 3 are prepared by using the same method as in the method for producing the toner of Example 1 except that the composition and the production method are changed to those described in Table 1. The electrostatic charge image developers of Examples 2 to 13 and Comparative Examples 2 and 3 are prepared by using the same method as in Example 1.

The obtained electrostatic charge image development toners and electrostatic charge image developers of Examples 1 to 13 and Comparative Examples 1 to 3 are evaluated in the following manner. The evaluation results are summarized in Table 1.

Evaluation

Evaluation Method

The developers obtained as described above are charged into a developing unit of an image forming apparatus "DocuCentre Color 400 available from Fuji Xerox Co., Ltd." as described in Table 1. In an environment at a temperature of 28° C. and a humidity of 85% RH, the image forming apparatus outputs a black (K color) solid image (margin on top and bottom edges: 10 mm) on five sheets of MCP256 (available from Oji Paper Co., Ltd., product name: Miller coat platinum, basis weight 256 g/m$^2$) stored at 4° C. The images on the sheets are evaluated in the following manner.

Gloss Unevenness Evaluation Item 1: Gloss Difference Between Top Edge and Bottom Edge of First Sheet Gloss unevenness is evaluated on the basis of a gloss difference which is a difference between the mean of the values at three points (right, center, left) on the K color top edge of the first sheet and the mean of the values at three points (right, center, left) on the K color bottom edge of the first sheet. The evaluation criteria are described below.

A: A gloss difference between the top edge and the bottom edge is less than 2°.

B: A gloss difference between the top edge and the bottom edge is 2° or more and less than 4°, which is a practically acceptable level.

C: A gloss difference between the top edge and the bottom edge is 5° or more.

Gloss Unevenness Evaluation Item 2: Gloss Difference Between Bottom Edge of First Sheet and Bottom Edge of Fifth Sheet Gloss unevenness is evaluated on the basis of a gloss difference which is a difference between the mean of the values (right, center, left) on the K color bottom edge of the first sheet and the mean of the values (right, center, left) on the K color bottom edge of the fifth sheet. The evaluation criteria are described below.

A: A gloss difference between the bottom edge of the first sheet and the bottom edge of the fifth sheet is less than 2°.

B: A gloss difference between the bottom edge of the first sheet and the bottom edge of the fifth sheet is 2° or more and less than 4°, which is a practically acceptable level.

C: A gloss difference between the bottom edge of the first sheet and the bottom edge of the fifth sheet is 5° or more.

Cold Offset Evaluation

The surface temperature of a fixing roller is set at 130° C. under the above-described conditions, and the fixed image is outputted on ten sheets. The fixed image on the tenth sheet is evaluated. The evaluation criteria are described below.

A: There is no problem at all.

B: A few image defects are found, but there is no problem.

C: Minor image defects are found at an acceptable level.

D: Image defects are found at an unacceptable level.

TABLE 1

| | Proportion in toner base particles | | | | | Maximum slope (absolute value) of log (G") | | | |
|---|---|---|---|---|---|---|---|---|---|
| | PAC content | Shell content | Stirring speed (rpm) | Bi- or higher functional (meth)acrylate compound | Proportion of polyfunctional monomer | 60° C. to 90° C. | 90° C. to 130° C. | G" (Pa · s) at 60° C. | Melting point of release agent (° C.) |
| Example 1 | 2.0% | 40% | 250 | 1,10-dodecanediol diacrylate | 2.0% | 0.08 | 0.05 | $4.8 \times 10^8$ | 91 |
| Example 2 | 1.4% | 40% | 250 | 1,10-dodecanediol diacrylate | 2.0% | 0.12 | 0.06 | $6.0 \times 10^8$ | 91 |
| Example 3 | 1.0% | 40% | 250 | 1,10-dodecanediol diacrylate | 2.0% | 0.15 | 0.08 | $8.2 \times 10^8$ | 91 |
| Example 4 | 2.0% | 40% | 250 | 1,10-dodecanediol diacrylate | 3.5% | 0.09 | 0.06 | $9.2 \times 10^8$ | 91 |
| Example 5 | 2.0% | 40% | 250 | 1,10-dodecanediol diacrylate | 0.5% | 0.10 | 0.05 | $1.3 \times 10^8$ | 91 |
| Example 6 | 1.0% | 40% | 250 | 1,10-dodecanediol diacrylate | 3.5% | 0.16 | 0.08 | $9.6 \times 10^8$ | 91 |

TABLE 1-continued

| | | | | | | | | | |
|---|---|---|---|---|---|---|---|---|---|
| Example 7 | 1.0% | 40% | 250 | 1,10-dodecanediol diacrylate | 0.5% | 0.15 | 0.07 | $1.2 \times 10^8$ | 91 |
| Example 8 | 1.4% | 40% | 250 | 1,10-dodecanediol diacrylate | 2.0% | 0.12 | 0.06 | $5.8 \times 10^8$ | 75 |
| Example 9 | 1.4% | 40% | 250 | 1,10-dodecanediol diacrylate | 2.0% | 0.12 | 0.06 | $6.2 \times 10^8$ | 100 |
| Example 10 | 1.4% | 40% | 250 | 1,10-dodecanediol diacrylate | 2.0% | 0.12 | 0.06 | $6.1 \times 10^8$ | 105 |
| Example 11 | 1.4% | 40% | 250 | pentaerythritol triacrylate | 1.5% | 0.12 | 0.06 | $8.7 \times 10^8$ | 91 |
| Example 12 | 1.4% | 40% | 250 | ditrimethylolpropane tetraacrylate | 1.0% | 0.12 | 0.06 | $9.2 \times 10^8$ | 91 |
| Example 13 | 1.4% | 40% | 250 | 1,10-dodecanediol diacrylate | 2.0% | 0.12 | 0.06 | $6.0 \times 10^8$ | 91 |
| Comparative Example 1 | 1.4% | 40% | 200 | 1,10-dodecanediol diacrylate | 2.0% | 0.17 | 0.10 | $5.5 \times 10^8$ | 91 |
| Comparative Example 2 | 1.4% | 40% | 250 | — | 0.0% | 0.06 | 0.05 | $7.8 \times 10^7$ | 91 |
| Comparative Example 3 | 1.4% | 40% | 250 | 1,10-dodecanediol diacrylate | 5.0% | 0.18 | 0.06 | $1.5 \times 10^9$ | 91 |

| | | | | | | Evaluation results for gloss Unevenness | | |
|---|---|---|---|---|---|---|---|---|
| | Maximum endothermic peak temperature (° C.) | Gel fraction of binder resin | Al content (%) | BET specific surface area | Difference in differential thermal analysis (° C.) | Gloss difference between top edge and bottom edge of first sheet | Gloss difference between bottom edge of first sheet and bottom edge of fifth sheet | Evaluation results for cold offset |
| Example 1 | 90 | 7.6% | 0.43% | 2.3 | 5 | A | A | A |
| Example 2 | 90 | 6.2% | 0.22% | 2.2 | 5 | A | A | A |
| Example 3 | 90 | 5.8% | 0.08% | 1.9 | 5 | A | A | A |
| Example 4 | 90 | 10.2% | 0.44% | 2.4 | 8 | B | A | A |
| Example 5 | 90 | 0.8% | 0.46% | 2.2 | 4 | A | B | B |
| Example 6 | 90 | 9.7% | 0.08% | 2.1 | 8 | A | A | A |
| Example 7 | 90 | 0.6% | 0.09% | 1.6 | 4 | A | A | B |
| Example 8 | 75 | 6.1% | 0.21% | 2.2 | 5 | A | A | A |
| Example 9 | 98 | 6.2% | 0.26% | 2.1 | 5 | A | A | C |
| Example 10 | 103 | 6.2% | 0.23% | 2.2 | 5 | B | A | C |
| Example 11 | 90 | 7.3% | 0.22% | 2.3 | 5 | A | A | B |
| Example 12 | 90 | 7.8% | 0.23% | 2.2 | 5 | A | A | C |
| Example 13 | 90 | 6.2% | 0.25% | 2.2 | 5 | A | A | A |
| Comparative Example 1 | 90 | 5.8% | 0.32% | 2.3 | 5 | B | C | C |
| Comparative Example 2 | 90 | 0.0% | 0.18% | 1.5 | 3 | C | C | C |
| Comparative Example 3 | 90 | 12.3% | 0.27% | 2.6 | 9 | C | B | B |

In Table 1, the term "difference in differential thermal analysis" refers to a difference in endothermic peak temperature of the release agent between first temperature rising and second temperature rising in differential scanning calorimetric analysis.

The results shown in Table 1 indicate that the electrostatic charge image development toners of Examples may provide images with less gloss unevenness than the electrostatic charge image development toners of Comparative Examples, even when recording media stored in a low-temperature environment (4° C.) are used.

The electrostatic charge image development toners of Examples may reduce cold offset.

Preparation of Amorphous Polyester Resin Dispersion (A1)

Terephthalic acid: 70 parts

Fumaric acid: 35 parts

Ethylene glycol: 45 parts 1,5-Pentanediol: 46 parts

These materials are placed in a content flask equipped with a stirrer, a nitrogen inlet tube, a temperature sensor, and a fractionating column. The mixture is heated to 220° C. over 1 hour under nitrogen gas flow. Titanium tetrabutoxide is added in an amount of 2 parts per 100 parts of the above materials. While generated water is distilled off, the mixture is heated to 240° C. over 0.5 hours, and the dehydration condensation reaction continues at 240° C. for 1 hour. The reaction product is then cooled. A polyester resin having a weight-average molecular weight of 30,000 and a glass transition temperature of 62° C. is synthesized accordingly. In a container equipped with a temperature controlling unit and a nitrogen purging unit, 40 parts of ethyl acetate and 25 parts of 2-butanol are placed to form a solvent mixture. The polyester resin (100 parts) is gradually added to and dissolved in the solvent mixture. A 10% aqueous ammonia solution (in an amount corresponding to three times the acid value of the resin by molar ratio) is added to the solution, and the mixture is stirred for 30 minutes. Next, the container is purged with dry nitrogen and maintained at 40° C. To the mixture, 400 parts of ion exchange water is added dropwise at a rate of 2 parts/min under stirring to cause emulsification. After completion of dropwise addition, the emulsion is returned to 25° C. A resin particle dispersion in which resin particles having a volume-average particle size of 200 nm are dispersed is obtained accordingly. The solids content of the resin particle dispersion is adjusted to 20% by addition of ion exchange water to provide an amorphous polyester resin dispersion (A1).

Preparation of Amorphous Polyester Resin Dispersion (A2)

Terephthalic acid: 63 parts
Fumaric acid: 30 parts
Trimellitic acid: 7 parts
Ethylene glycol: 45 parts
1,5-Pentanediol: 46 parts These materials are placed in a flask equipped with a stirrer, a nitrogen inlet tube, a temperature sensor, and a fractionating column. The mixture is heated to 220° C. over 1 hour under nitrogen gas flow. Titanium tetrabutoxide is added in an amount of 1 part per 100 parts of the above materials. While generated water is distilled off, the mixture is heated to 240° C. over 0.5 hours, and the dehydration condensation reaction continues at 240° C. for 1 hour. The reaction product is then cooled. A polyester resin having a weight-average molecular weight of 160,000 and a glass transition temperature of 62° C. is synthesized accordingly. In a container equipped with a temperature controlling unit and a nitrogen purging unit, 40 parts of ethyl acetate and 25 parts of 2-butanol are placed to form a solvent mixture. The polyester resin (100 parts) is gradually added to and dissolved in the solvent mixture. A 10% aqueous ammonia solution (in an amount corresponding to three times the acid value of the resin by molar ratio) is added to the solution, and the mixture is stirred for 30 minutes. Next, the container is purged with dry nitrogen and maintained at 40° C. To the mixture, 400 parts of ion exchange water is added dropwise at a rate of 2 parts/min under stirring to cause emulsification. After completion of dropwise addition, the emulsion is returned to 25° C. A resin particle dispersion in which resin particles having a volume-average particle size of 200 nm are dispersed is obtained accordingly. The solids content of the resin particle dispersion is adjusted to 20% by addition of ion exchange water to provide an amorphous polyester resin dispersion (A2).

Preparation of Release Agent Particle Dispersion B

Paraffin wax (HNP-9 available from Nippon Seiro Co., Ltd.): 100 parts
Anionic surfactant (Neogen RK available from DKS Co. Ltd.): 1 part
Ion exchange water: 350 parts These materials are mixed and heated to 100° C. The mixture is dispersed with a homogenizer (ULTRA-TURRAX T50 available from IKA) and then dispersed with a Manton-Gaulin high-pressure homogenizer (available from Gaulin Corporation) to provide a release agent particle dispersion (solids content: 20%) in which release agent particles having a volume-average particle size of 200 nm are dispersed.

Preparation of Black Colored Particle Dispersion

Carbon black (Regal 330 available from Cabot Corporation): 50 parts
Ionic surfactant Neogen RK (available from DKS Co. Ltd.): 5 parts
Ion exchange water: 192.9 parts These components are mixed and processed with Ultimizer (available from Sugino Machine Limited) at 240 MPa for 10 minutes to prepare a black colored particle dispersion (solids content: 20%).

Method for Producing Toner

Ion exchange water: 200 parts
Amorphous polyester resin dispersion (A1): 170 parts
Black colored particle dispersion: 30 parts
Release agent particle dispersion B: 35 parts
Anionic surfactant (TaycaPower available from TAYCA Corporation): 2.8 parts These materials are placed in a round stainless steel flask. The pH of the mixture is adjusted to 3.5 by addition of 0.1N (0.1 mol/L) nitric acid, and a PAC aqueous solution of 2.0 parts of PAC (available from Oji Paper Co., Ltd., 30% powder product) in 30 parts of ion exchange water (to increase the aluminum content in the toner) is added. The mixture is dispersed at 30° C. by using a homogenizer (ULTRA-TURRAX T50 available from IKA), and the dispersion is heated to 45° C. in a heating oil bath and maintained until the volume-average particle size reaches 4.8 μm. Subsequently, 60 parts of a resin particle dispersion (A2) is added, and the mixture is maintained for 30 minutes. Subsequently, 60 parts of the resin particle dispersion (A2) is further added when the volume-average particle size reaches 5.2 μm, and the mixture is maintained for 30 minutes. Next, 20 parts of a 10 mass % nitrilotriacetic acid (NTA) metal salt aqueous solution (Chelest 70 available from Chelest Corporation) is added, and the pH of the mixture is then adjusted to 9.0 with a 1N (1 mol/L) sodium hydroxide aqueous solution. Then, 1.0 part of an anion activator (TaycaPower) is added, and the mixture is heated to 85° C. under stirring and maintained for 5 hours. Subsequently, the mixture is cooled to 20° C. at a rate of 20° C./min, filtered, washed well with ion exchange water, and dried to provide toner particles having a volume-average particle size of 6.0 μm.

The obtained toner particles (100 parts by mass) are blended with 1.5 parts by mass of hydrophobic silica (RY50 available from Nippon Aerosil Co., Ltd.) and 1.0 part by mass of hydrophobic titanium oxide (T805 available from Nippon Aerosil Co., Ltd.) by using a sample mill at 10,000 rpm for 30 seconds. The mixture is then screened through a vibrating screen with a mesh size of 45 μm to prepare a toner (electrostatic charge image development toner) of Example 14. The obtained toner has a volume-average particle size of 6.1 μm.

Preparation of Carrier

A carrier prepared as described below is used.

Ferrite particles (volume-average particle size: 50 μm): 100 parts
Toluene: 14 parts
Styrene-methyl methacrylate copolymer (composition ratio: 90/10, Mw=80,000): 2 parts
Carbon black (R330 available from Cabot Corporation): 0.2 parts First, these components except for ferrite particles are stirred with a stirrer for 10 minutes to prepare a coating dispersion. Next, the coating dispersion and the ferrite particles are placed in a vacuum degassing kneader and stirred at 60° C. for 30 minutes. The mixture is further degassed with heating under reduced pressure and dried to prepare a carrier.

Preparation of Electrostatic Charge Image Developer

The obtained carrier and the obtained toner are placed in a V-blender at a ratio of toner:carrier=5:95 (mass ratio) and stirred for 20 minutes to provide a developer (electrostatic charge image developer) of Example 14.

Comparative Example 4

Preparation of Amorphous Polyester Resin Dispersion (A3)

Terephthalic acid: 30 parts by mole
Fumaric acid: 70 parts by mole
Ethylene oxide adduct of bisphenol A: 5 parts by mole
Propylene oxide adduct of bisphenol A: 95 parts by mole These materials are placed in a flask equipped with a stirrer, a nitrogen inlet tube, a temperature sensor, and a fractionating column. The mixture is heated to 220° C. over 1 hour. Titanium tetrabutoxide is added in an amount of 1 part per 100 parts of the above materials. While generated water is distilled off, the mixture is heated to 230° C. over 0.5 hours, and the dehydration condensation reaction continues at 230° C. for 1 hour. The reaction product is then cooled. A polyester resin having a weight-average molecular weight of 18,000 and a glass transition temperature of 60° C. is synthesized accordingly.

In a container equipped with a temperature controlling unit and a nitrogen purging unit, 40 parts of ethyl acetate and 25 parts of 2-butanol are placed to form a solvent mixture. The polyester resin (100 parts) is gradually added to and dissolved in the solvent mixture. A 10% aqueous ammonia solution (in an amount corresponding to three times the acid value of the resin by molar ratio) is added to the solution, and the mixture is stirred for 30 minutes.

Next, the container is purged with dry nitrogen and maintained at 40° C. To the mixture, 400 parts of ion exchange water is added dropwise at a rate of 2 parts/min under stirring to cause emulsification. After completion of dropwise addition, the emulsion is returned to 25° C. A resin particle dispersion in which resin particles having a volume-average particle size of 200 nm are dispersed is obtained accordingly. The solids content of the resin particle dispersion is adjusted to 20% by addition of ion exchange water to provide an amorphous polyester resin dispersion (A3).

Method for Producing Toner

Ion exchange water: 200 parts

Amorphous polyester resin dispersion (A3): 170 parts

Black colored particle dispersion: 30 parts

Release agent particle dispersion B: 35 parts

Anionic surfactant (TaycaPower): 2.8 parts

These materials are placed in a round stainless steel flask. The pH of the mixture is adjusted to 3.5 by addition of 0.1N nitric acid, and a PAC aqueous solution of 0.3 parts of PAC (available from Oji Paper Co., Ltd., 30% powder product) in 7 parts of ion exchange water is added. The mixture is dispersed at 30° C. by using a homogenizer (ULTRA-TURRAX T50 available from IKA), and the dispersion is heated to 45° C. in a heating oil bath and maintained until the volume-average particle size reaches 5.0 μm. Subsequently, 100 parts of a resin particle dispersion (A3) is added, and the mixture is maintained for 30 minutes. Next, 20 parts of a 10 mass % nitrilotriacetic acid (NTA) metal salt aqueous solution (Chelest 70 available from Chelest Corporation) is added, and the pH of the mixture is then adjusted to 9.0 with a 1N sodium hydroxide aqueous solution. Subsequently, the mixture is heated to 85° C. under stirring and maintained for 5 hours. Subsequently, the mixture is cooled to 20° C. at a rate of 20° C./min, filtered, washed well with ion exchange water, and dried to provide toner particles having a volume-average particle size of 5.9 μm.

Preparation of Electrostatic Charge Image Developer

A developer (electrostatic charge image developer) of Comparative Example 4 is prepared by the same method as in Example 14 using the obtained toner particles.

Examples 15 to 18 and Comparative Examples 5 and 6

The electrostatic charge image development toners of Examples 15 to 18 and Comparative Examples 5 and 6 are prepared by using the same method as in the method for producing the toner of Example 14 except that the composition and the production method are changed to those described in Table 2. The electrostatic charge image developers of Examples 15 to 18 and Comparative Examples 5 and 6 are prepared by using the same method as in Example 14.

The obtained electrostatic charge image development toners and electrostatic charge image developers of Examples 14 to 18 and Comparative Examples 4 to 6 are evaluated in the following manner. The evaluation results are summarized in Table 2.

Evaluation

Evaluation Method

The developer obtained as described above is charged into a copier Versant 3100 Press available from Fuji Xerox Co., Ltd., and the humidity is controlled at 15% RH at 10° C. for 17 hours. A K color solid image (margin on top and bottom edges: 10 mm) is outputted on ten sheets with A3 Colotech 300 gsm (product name, available from Fuji Xerox Co., Ltd., basis weight 300 g/m$^2$).

Gloss Unevenness Evaluation Item 1: Gloss Difference Between Top Edge and Bottom Edge of First Sheet Gloss unevenness is evaluated on the basis of a gloss difference which is a difference between the mean of the values at three points (right, center, left) on the K color top edge of the first sheet and the mean of the values at three points (right, center, left) on the K color bottom edge of the first sheet. The evaluation criteria are described below.

A: A gloss difference between the top edge and the bottom edge is less than 2°

B: A gloss difference between the top edge and the bottom edge is 2° or more and less than 4°

C: A gloss difference between the top edge and the bottom edge is 4° or more and less than 6°, which is a practically acceptable level.

D: A gloss difference between the top edge and the bottom edge is 6° or more, which is a practically unacceptable level.

Gloss Difference Between Bottom Edge of First Sheet and Bottom Edge of Fifth Sheet Gloss unevenness is evaluated on the basis of a gloss difference which is a difference between the mean of the values (right, center, left) on the K color bottom edge of the first sheet and the mean of the values (right, center, left) on the K color bottom edge of the fifth sheet. The evaluation criteria are described below.

A: A gloss difference between the top edge and the bottom edge is less than 2°.

B: A gloss difference between the top edge and the bottom edge is 2° or more and less than 4° C.: A gloss difference between the top edge and the bottom edge is 4° or more and less than 6°, which is a practically acceptable level.

D: A gloss difference between the top edge and the bottom edge is 6° or more, which is a practically unacceptable level.

Cold Offset Evaluation

The surface temperature of a fixing roller is set at 130° C. under the above-described conditions, and the fixed image is outputted on ten sheets. The fixed image on the tenth sheet is evaluated. The evaluation criteria are described below.

A: There is no problem at all.

B: A few image defects are found, but there is no problem.

C: Minor image defects are found at an acceptable level.

D: Image defects are found at an unacceptable level.

TABLE 2

| | PAC content (parts) | First addition of resin particle dispersion: amount of addition (parts) | First addition of resin particle dispersion: retention temperature and time | Second addition of resin particle dispersion: amount of addition (parts) | Second addition of resin particle dispersion: retention temperature and time | Amount of surfactant additionally added (parts) | Maximum slope (absolute value) of log (G"): 60° C. to 90° C. | Maximum slope (absolute value) of log (G"): 90° C. to 130° C. |
|---|---|---|---|---|---|---|---|---|
| Example 14 | 2.0 | 60 | 45° C. for 30 min | 60 | 45° C. for 30 min | 1.0 | 0.07 | 0.04 |
| Example 15 | 1.0 | 60 | 45° C. for 30 min | 60 | 45° C. for 30 min | 1.0 | 0.10 | 0.06 |
| Example 16 | 0.5 | 60 | 45° C. for 30 min | 60 | 45° C. for 30 min | 1.0 | 0.13 | 0.07 |
| Example 17 | 2.0 | 90 | 45° C. for 30 min | 90 | 45° C. for 30 min | 1.0 | 0.07 | 0.04 |
| Example 18 | 0.5 | 30 | 45° C. for 30 min | 30 | 45° C. for 30 min | 1.0 | 0.14 | 0.08 |
| Comparative Example 4 | 2.0 | 120 | 45° C. for 30 min | — | — | — | 0.20 | 0.11 |
| Comparative Example 5 | 0.5 | 120 | 45° C. for 30 min | — | — | — | 0.22 | 0.13 |
| Comparative Example 6 | 2.0 | 30 | 45° C. for 30 min | — | — | — | 0.19 | 0.10 |

| | G" (Pa · s) at 60° C. | Gel fraction of binder resin | 1,500 $cm^{-1}$/720 $cm^{-1}$ | 820 $cm^{-1}$/720 $cm^{-1}$ | ½ Outflow temperature in flow tester (° C.) | Evaluation results for gloss Unevenness: Gloss difference between top edge and bottom edge of first sheet | Evaluation results for gloss Unevenness: Gloss difference between bottom edge of first sheet and bottom edge of fifth sheet | Evaluation results for cold offset |
|---|---|---|---|---|---|---|---|---|
| Example 14 | $8.8 \times 10^8$ | 7.3% | 0.6 | 0.4 | 145 | A | A | A |
| Example 15 | $3.7 \times 10^8$ | 5.4% | 0.5 | 0.3 | 132 | A | A | A |
| Example 16 | $1.2 \times 10^8$ | 3.7% | 0.4 | 0.3 | 124 | A | A | A |
| Example 17 | $4.2 \times 10^9$ | 10.3% | 0.5 | 0.3 | 153 | B | A | A |
| Example 18 | $7.3 \times 10^7$ | 0.8% | 0.4 | 0.3 | 121 | A | A | B |
| Comparative Example 4 | $1.5 \times 10^{10}$ | 4.2% | 0.9 | 0.7 | 140 | C | D | C |
| Comparative Example 5 | $4.3 \times 10^8$ | 2.5% | 0.8 | 0.6 | 121 | D | C | B |
| Comparative Example 6 | $6.3 \times 10^8$ | 2.2% | 0.9 | 0.7 | 136 | D | C | B |

In Table 2, the ratio "1,500 $cm^{-1}$/720 $cm^{-1}$" is the ratio of the absorbance at a wavelength of 1,500 $cm^{-1}$ to the absorbance at a wavelength of 720 $cm^{-1}$ in infrared absorption spectrum analysis of the toner particles in the toner. The ratio "820 $cm^{-1}$/720 $cm^{-1}$" is the ratio of the absorbance at a wavelength of 820 $cm^{-1}$ to the absorbance at a wavelength of 720 $cm^{-1}$ in infrared absorption spectrum analysis of the toner particles in the toner.

The results shown in Table 2 indicate that the electrostatic charge image development toners of Examples may provide images with less gloss unevenness than the electrostatic charge image development toners of Comparative Examples, even when recording media stored in a low-temperature environment (4° C.) are used.

The electrostatic charge image development toners of Examples may reduce cold offset.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrostatic charge image development toner satisfying the following:

a maximum slope of an absolute value of log (loss modulus G") from 60° C. to 90° C. is 0.07 or more and 0.16 or less; and a maximum slope of an absolute value of log (loss modulus G") from 90° C. to 130° C. is 0.08 or less, wherein G"(60) is $5.0 \times 10^7$ Pa or more and $1.0 \times 10^{10}$ Pa or less, where G"(60) is a loss modulus at 60° C., wherein the toner comprises a styrene-acrylic resin as a binder resin, and wherein a gel fraction of a binder resin in the toner is 0.5 mass % or more and 8.0 mass % or less.

2. The electrostatic charge image development toner according to claim 1, wherein the toner further comprises a release agent.

3. The electrostatic charge image development toner according to claim 2, wherein a difference in endothermic peak temperature of the release agent between first temperature rising and second temperature rising in differential scanning calorimetric analysis is 5° C. or less.

4. An electrostatic charge image developer comprising the electrostatic charge image development toner according to claim 1.

5. An electrostatic charge image development toner satisfying the following:

a maximum slope of an absolute value of log (loss modulus G") from 60° C. to 90° C. is 0.08 or more and 0.16 or less; and a maximum slope of an absolute value of log (loss modulus G") from 90° C. to 130° C. is 0.08 or less, wherein G"(60) is $1.0\times10^{8}$ Pa or more and $1.0\times10^{10}$ Pa or less, where G"(60) is a loss modulus at 60° C., wherein the toner comprises a styrene-acrylic resin as a binder resin, and wherein a gel fraction of a binder resin in the toner is 0.5 mass % or more and 8.0 mass % or less.

6. The electrostatic charge image development toner according to claim 5, wherein the toner has a maximum endothermic peak temperature of 70° C. or higher and 100° C. or lower.

7. The electrostatic charge image development toner according to claim 6, wherein the toner has a maximum endothermic peak temperature of 75° C. or higher and 95° C. or lower.

8. The electrostatic charge image development toner according to claim 5, wherein the toner has an Al content of 0.05 mass % or more and 0.5 mass % or less.

9. The electrostatic charge image development toner according to claim 5, wherein the toner has a BET specific surface area of 1.5 $m^2/g$ or more and 2.5 $m^2/g$ or less.

10. An electrostatic charge image developer comprising the electrostatic charge image development toner according to claim 5.

11. An electrostatic charge image development toner satisfying the following:

a maximum slope of an absolute value of log (loss modulus G") from 60° C. to 90° C. is 0.07 or more and 0.14 or less; and a maximum slope of an absolute value of log (loss modulus G") from 90° C. to 130° C. is 0.08 or less, wherein G"(60) is $5.0\times10^{7}$ Pa or more and $5.0\times10^{9}$ Pa or less, where G"(60) is a loss modulus at 60° C., wherein the electrostatic charge image development toner further comprises an amorphous polyester resin as a binder resin, and wherein a gel fraction of a binder resin in the toner is 1 mass % or more and 10 mass % or less.

12. The electrostatic charge image development toner according to claim 11, wherein a ratio of an absorbance at a wavelength of 1,500 $cm^{-1}$ to an absorbance at a wavelength of 720 $cm^{-1}$ is 0.6 or less, and a ratio of an absorbance at a wavelength of 820 $cm^{-1}$ to the absorbance at a wavelength of 720 $cm^{-1}$ is 0.4 or less in infrared absorption spectrum analysis of toner particles in the toner.

13. The electrostatic charge image development toner according to claim 11, wherein the amorphous polyester resin has a weight-average molecular weight of 50,000 or more and 200,000 or less.

14. The electrostatic charge image development toner according to claim 11, wherein the toner has a ½ outflow temperature of 120° C. or higher and 200° C. or lower as determined with a flow tester.

15. An electrostatic charge image developer comprising the electrostatic charge image development toner according to claim 11.

* * * * *